US012410618B2

(12) United States Patent
Boucké

(10) Patent No.: US 12,410,618 B2
(45) Date of Patent: Sep. 9, 2025

(54) MULTI-PURPOSE TILE SYSTEM, TILE COVERING, AND TILE

(71) Applicant: I4F Licensing NV, Turnhout (BE)

(72) Inventor: Eddy Alberic Boucké, Menen (BE)

(73) Assignee: i4F Licensing NV, Turnhout (BE)

( * ) Notice: Subject to any disclaimer, the term of this patent is extended or adjusted under 35 U.S.C. 154(b) by 0 days.

(21) Appl. No.: 18/188,642

(22) Filed: Mar. 23, 2023

(65) Prior Publication Data

US 2023/0279668 A1 Sep. 7, 2023

Related U.S. Application Data

(63) Continuation of application No. 17/288,082, filed as application No. PCT/EP2019/076441 on Sep. 30, 2019, now Pat. No. 11,639,605.

(30) Foreign Application Priority Data

Oct. 26, 2018 (NL) ..... 2021885

(51) Int. Cl.

| | |
|---|---|
| ***E04F 13/08*** | (2006.01) |
| ***E04F 13/077*** | (2006.01) |
| ***E04F 13/18*** | (2006.01) |
| ***E04F 15/02*** | (2006.01) |

(52) U.S. Cl.

CPC ..... *E04F 13/0894* (2013.01); *E04F 13/077* (2013.01); *E04F 13/18* (2013.01); *E04F 15/02* (2013.01); *E04F 15/02038* (2013.01); *E04F 2201/0138* (2013.01); *E04F 2201/0153* (2013.01); *E04F 2201/023* (2013.01); *E04F 2201/03* (2013.01)

(58) Field of Classification Search

CPC ..... E04F 13/0894; E04F 13/077; E04F 13/18; E04F 15/02038; E04F 2201/0138; E04F 2201/0153; E04F 2201/023; E04F 2201/03

USPC ..... 52/578, 589.1, 782.1

See application file for complete search history.

(56) References Cited

U.S. PATENT DOCUMENTS

| | | | | |
|---|---|---|---|---|
| 10,738,477 | B2 | 8/2020 | Hannig | |
| 10,753,105 | B2 * | 8/2020 | Van Hooydonck | E04F 15/02038 |
| 11,225,800 | B2 | 1/2022 | De Rick et al. | |
| 2004/0128934 | A1 | 7/2004 | Hecht | |
| 2004/0177584 | A1 | 9/2004 | Pervan | |
| 2005/0028474 | A1 | 2/2005 | Kim | |
| 2007/0022694 | A1 * | 2/2007 | Chen | E04F 15/10 52/578 |
| 2008/0010937 | A1 * | 1/2008 | Pervan | E04F 15/02 52/588.1 |

(Continued)

FOREIGN PATENT DOCUMENTS

| | | |
|---|---|---|
| CA | 2715964 A1 | 1/2010 |
| CA | 3056031 A1 | 9/2018 |

(Continued)

*Primary Examiner* — Brent W Herring

(74) *Attorney, Agent, or Firm* — The Webb Law Firm

(57) ABSTRACT

The invention relates to a multi-purpose tile system, in particular a floor tile system, including a plurality of multi-purpose tiles, in particular floor tiles, wall tiles, or ceiling tiles. The invention also relates to a tile covering, in particular floor covering, ceiling covering, or wall covering, consisting of mutually coupled tiles according to the invention. The invention further relates to a tile for use in multi-purpose tile system according to the invention.

20 Claims, 13 Drawing Sheets

(56) References Cited

U.S. PATENT DOCUMENTS

| | | | | |
|---|---|---|---|---|
| 2011/0167744 | A1 | 7/2011 | Whispell et al. | |
| 2013/0309441 | A1 | 11/2013 | Hannig | |
| 2017/0037640 | A1 | 2/2017 | Boucké et al. | |
| 2017/0241136 | A1 | 8/2017 | Kell | |
| 2017/0328072 | A1 | 11/2017 | Hannig | |
| 2018/0010342 | A1* | 1/2018 | Van Hooydonck ... | E04F 15/105 |
| 2018/0094441 | A1 | 4/2018 | Boo | |
| 2019/0017278 | A1 | 1/2019 | De Rick et al. | |
| 2019/0136545 | A1* | 5/2019 | De Rick ..... | E04F 15/107 |
| 2019/0211569 | A1* | 7/2019 | Boo ..... | E04F 15/105 |
| 2019/0323243 | A1 | 10/2019 | Cappelle | |
| 2020/0011070 | A1* | 1/2020 | Van Hooydonck ..... | E04F 15/02038 |
| 2020/0208417 | A1* | 7/2020 | LeBlanc ..... | B32B 9/042 |

FOREIGN PATENT DOCUMENTS

| | | | |
|---|---|---|---|
| CN | 205990727 | U | 3/2017 |
| CN | 107100343 | A | 8/2017 |
| CN | 108026728 | A | 5/2018 |
| DE | 10224540 | A1 | 12/2003 |
| KR | 1020050015709 | | 2/2005 |
| TW | 201537005 | A | 10/2015 |
| WO | 2007012137 | A1 | 2/2007 |
| WO | 2015104680 | A1 | 7/2015 |
| WO | 2016091819 | A1 | 6/2016 |
| WO | 2016113706 | A1 | 7/2016 |
| WO | 2017115202 | A1 | 7/2017 |
| WO | 2017187298 | A2 | 11/2017 |
| WO | 2018215550 | A1 | 11/2018 |
| WO | 2021045612 | A1 | 3/2021 |

* cited by examiner

MULTI-PURPOSE TILE SYSTEM, TILE COVERING, AND TILE

CROSS-REFERENCE TO RELATED APPLICATIONS

This application is a continuation of U.S. patent application Ser. No. 17/288,082, filed on Sep. 30, 2019, which is the United States national phase of International Application No. PCT/EP2019/076441 filed Sep. 30, 2019, and claims priority to The Netherlands Patent Application No. 2021885 filed Oct. 26, 2018, the disclosures of which are hereby incorporated by reference in their entireties.

BACKGROUND OF THE INVENTION

Field of the Invention

The invention relates to a multi-purpose tile system, in particular a floor tile system, comprising a plurality of multi-purpose tiles, in particular floor tiles, wall tiles, or ceiling tiles. The invention also relates to a tile covering, in particular floor covering, ceiling covering, or wall covering, consisting of mutually coupled tiles according to the invention. The invention further relates to a tile for use in multi-purpose tile system according to the invention. The invention moreover relates to an installation method for installing the system according to the invention to create a tile covering.

Description of Related Art

The last decade has seen enormous advance in the market for laminate for hard floor covering. It is known to install floor panels on a underlying floor in various ways. It is, for example, known that the floor panels are attached at the underlying floor, either by gluing or by nailing them on. This technique has a disadvantage that is rather complicated and that subsequent changes can only be made by breaking out the floor panels. According to an alternative installation method, the floor panels are installed loosely onto the subflooring, whereby the floor panels mutually match into each other by means of a tongue and groove coupling, whereby mostly they are glued together in the tongue and groove, too. The floor obtained in this manner, also called a floating parquet flooring, has as an advantage that it is easy to install and that the complete floor surface can move which often is convenient in order to receive possible expansion and shrinkage phenomena. A disadvantage with a floor covering of the above-mentioned type, above all, if the floor panels are installed loosely onto the subflooring, consists in that during the expansion of the floor and its subsequent shrinkage, the floor panels themselves can drift apart, as a result of which undesired gaps can be formed, for example, if the glue connection breaks. In order to remedy this disadvantage, techniques have already been through of whereby connection elements made of metal are provided between the single floor panels in order to keep them together. Such connection elements, however, are rather expensive to make and, furthermore, their provision or the installation thereof is a time-consuming occupation. Floor panels having complementarily shaped coupling parts at opposing panel edges are also known. These known panels are typically rectangular and have complementarily shaped angling-down coupling parts at opposing long panel edges and complementarily shaped fold-down coupling parts at opposing short panel edges. Installation of these known floor panels is based upon the so-called fold-down technique, wherein the long edge of a first panel to be installed is firstly coupled to or inserted into the long edge of an already installed second panel in a first row, after which the short edge of the first panel is coupled to the short edge of an already installed third panel in a second row during lowering (folding down) the first panel, which installation fulfils the targeted requirement of a simple installation. In this manner a floor covering consisting of a plurality of parallel oriented rows of mutually coupled floor panels can be realized.

WO2017/187298 for example describes a set of floor panels, which is suitable for forming a floor covering in herringbone pattern, wherein these floor panels are oblong rectangular; wherein the long as well as the short edges are provided with mechanical coupling means; and wherein the male coupling part on the short edge can be inserted into the female coupling part on the long edge in one and the same turning movement which is used to insert the male coupling part on the long edge into the female coupling part on the long or short edge. WO2016/091819 describes a panel comprising a panel upper side and a panel lower side and also at least four panel edges which are situated opposite one another in pairs, with complementary retaining profiles which are provided in pairs on the panel edges and which match one another in such a way that panels of the same type can be fastened to one another, wherein at least one of the retaining profile pairs is provided with hook profiles, namely on a panel edge with a receiving hook and on the opposite panel edge with an arresting hook.

SUMMARY OF THE INVENTION

It is a first object of the invention to provide a multi-purpose tile system, wherein tiles can be mutually coupled in an improved manner.

It is a second object of the invention to provide a multi-purpose tile system, wherein an increased degree of freedom during installation of the tiles can be achieved.

It is a third object of the invention to provide a multi-purpose tile system, wherein special installation patterns, such as herringbone patterns, can be realized, in an improved manner.

It is a fourth object of the invention to provide a multi-purpose tile system, wherein the tiles can be produced in a relatively cost efficient manner.

At least one of these objects can be achieved by providing a multi-purpose system according to the preamble, wherein the tiles, and preferably each tile, comprise at least one first edge having a first coupling profile comprising: a sideward tongue extending in a direction substantially parallel to the upper side of the tile, at least one first downward flank lying at a distance from the sideward tongue, and a first downward recess formed between the sideward tongue and the first downward flank; at least one second edge having a second coupling profile comprising: a downward tongue extending in a direction substantially perpendicular to the upper side of the tile, at least one second downward flank lying at a distance from the downward tongue, a second downward recess formed between the downward tongue and the downward flank, and, preferably at least one second (vertically active) locking element; at least one third edge, and preferably at least two third edges, each third edge having a third coupling profile comprising: a third recess configured for accommodating at least a part of the sideward tongue of the first coupling profile of a further tile, said third recess being defined by an upper lip and a lower lip, wherein said lower lip is provided with an upward locking element, and preferably at least one third (vertically active) locking element, wherein the first coupling profile and the third coupling profile are configured such that two of such tiles can be coupled to each other at the first and third edges by means of a turning movement, wherein, in coupled condition: at least a part of the sideward tongue of the first coupling profile of a tile is inserted into the third recess of the third coupling profile of an adjacent tile, and at least a part of the upward locking element of the third coupling profile is inserted into the first downward recess of the first coupling profile, and wherein the second coupling profile and the third coupling profile are configured such that the two of such tiles can be coupled to each other at the second and third edges by means of a fold-down movement and/or a vertical movement, such that, in coupled condition, wherein, in coupled condition: at least a part of the downward tongue of the second coupling profile is inserted in the third recess of the third coupling profile, at least a part of the upward locking element of the third coupling profile is inserted in the second downward recess of the second coupling profile, and, if applied, at least one second locking element is facing, and preferably co-acting with, at least one third locking element to realise a vertical effect.

Typically, at least a part of the proximal side of the upward locking element of the third coupling profile, facing the third recess, is upwardly inclined in a direction away from the upper lip, and wherein at least one second locking element of the second coupling profile is provided at the second downward flank of the second coupling profile, and wherein at least one third locking element of the third coupling profile is provided at a distal side of the lower lip facing away from the third recess and/or a distal side of the upward locking element facing away from the third recess. A benefit of the combination of the presence of a second locking element provided at the second downward flank and a third locking element provided at a distal side of the lower lip facing away from the third recess and/or a distal side of the upward locking element facing away from the third recess and at least a part of the proximal side of the upward locking element of the third coupling profile, facing the third recess, being upwardly inclined in a direction away from the upper lip, is that coupling of adjacent panels is rather simple while sufficient mutual (vertical) locking between said panels can be ensured. The absence of locking element at said positions in combination with the so-called open groove structure may result in an unstable locking situation between the male and the female coupling parts of adjacent panels, in particular for coupling between the second coupling profile and the third coupling profile. The presence of described second and third locking elements may additionally prevent that the male coupling part of the second coupling profile might (slightly) displace, and in particular (slightly) tilt, for example towards the open space of the third recess, during use. Hence, friction between adjacent panels in a coupling condition can be prevented.

Typically, each tile of the tile system according to the invention comprises at least one first coupling profile, at least one second coupling, and at least one third coupling profile, and preferably a plurality, e.g. two, third coupling profiles. However, it is imaginable that at least a first tile (a first tile type) comprises at least one first coupling profile and at least one third coupling profile, without having a second coupling profile, while a second tile (a second tile type) comprises at least one second coupling profile and at least one third coupling profile, without having a first coupling profile. Alternatively, it is e.g. imaginable that at least a first tile (a first tile type) comprises at least one first coupling profile and at least one second coupling profile, without having a third coupling profile, while a second tile (a second tile type) comprises at least one third coupling profile and at without having a first coupling profile and/or a second coupling profile. Hence, each tile of the tile system according to the invention may have at least one first coupling profile and/or at least one second coupling profile and/or at least one third coupling profile. In case a tile of the system according to the invention is not provided with a coupling profile chosen from the group consisting of: the first coupling profile, the second coupling profile, and the third coupling profile; then this lacking coupling profile of said tile will be included in another tile of the system according to the invention. Hence, according to another aspect to the invention, it relates to a multi-purpose tile system, in particular a floor tile system, comprising a plurality of multi-purpose tiles, in particular floor tiles, wherein at least one first tile (type) comprises at least one first edge having a first coupling profile comprising: a sideward tongue extending in a direction substantially parallel to the upper side of the tile, at least one first downward flank lying at a distance from the sideward tongue, and a first downward recess formed between the sideward tongue and the first downward flank, wherein at least one second tile (type) comprises at least one second edge having a second coupling profile comprising: a downward tongue extending in a direction substantially perpendicular to the upper side of the tile, at least one second downward flank lying at a distance from the downward tongue, a second downward recess formed between the downward tongue and the downward flank, and preferably, at least one second locking element, and wherein at least one third tile (type) comprises at least one third edge having a third coupling profile comprising: a third recess configured for accommodating at least a part of the sideward tongue of the first coupling profile of a further tile, said third recess being defined by an upper lip and a lower lip, wherein said lower lip is provided with an upward locking element, and preferably, at least one third locking element, and wherein the first coupling profile and the third coupling profile are configured such that two of such tiles can be coupled to each other at the first and third edges by means of a turning movement, wherein, in coupled condition: at least a part of the sideward tongue of the first coupling profile of a tile is inserted into the third recess of the third coupling profile of an adjacent tile, and at least a part of the upward locking element of the third coupling profile is inserted into the first downward recess of the first coupling profile, and wherein the second coupling profile and the third coupling profile are configured such that the two of such tiles can be coupled to each other at the second and third edges by means of a fold-down movement and/or a vertical movement, wherein, in coupled condition: at least a part of the downward tongue of the second coupling profile is inserted in the third recess of the third coupling profile, and at least a part of the upward locking element of the third coupling profile is inserted in the second downward recess of the second coupling profile, if applied, at least one second locking element is facing, and preferably co-acting with, at least one third locking element to realise a vertical effect. The first tile and/or the second tile and/or the third tile may be formed by the same tile. The first tile may comprise at least one second coupling profile and/or at least one third coupling profile. The second tile may comprise at least one first coupling profile and/or at least one third coupling profile. The third tile may comprise at least one first coupling profile and/or at least one second coupling profile.

The tile system according to the invention has a plurality of significant advantages. A first main advantage is that the third coupling profile (female profile) is configured to co-act with both the first coupling profile (first male profile) and the second coupling profile (second male profile). This provides an enormous increase in how all tiles are mutually oriented in a tile covering to be realized. The classical row by row installation of tiles is still possible, but the compatibility of the third coupling profile with both the first coupling profile and the second coupling profile also allows the installation of various alternative installation patterns, such as for example, but not limited to, a herringbone pattern, while needing and using only a single tile type. In case of oblong (rectangular) tiles, the short edge of a tile can for example be coupled to either a short edge or to a long edge of an adjacent tile. Furthermore, each tile of the tile system can be manufactured in a relatively cost-efficient manner, since only three different coupling profiles, instead of the usual four different coupling profiles, will have to be realized during the production process, which will lead to at least a cost-saving in the machinery, and in particular the milling tools, which are used during the production process.

Preferably, each tile comprises a first pair of opposing edges consisting of the first edge and the third edge. Each tile preferably comprises a second pair of opposing edges consisting of the second edge and the third edge. By arranging the coupling profiles, which are configured to mutually cooperate, at opposing edges, the installation of the tiles of the tile system can be facilitated. The tiles of the tile system typically have a square, rectangular, triangular, hexagon, octagon, or other polygonal shape. However, other shapes, like a parallelogramical shape, are also imaginable as will be elucidated further below. Preferably, in case of a tile with an even number of edges, the number of third coupling profiles of said tile corresponds to the sum of the number of first coupling profiles and the number second coupling profiles. Typically, the number of first coupling profiles of a tile corresponds to the number of second coupling profiles, although deviations are imaginable, wherein a tile may for example comprise more second coupling profiles than first coupling profiles, or vice versa.

At least a number of tiles of the tile system according to the invention may be rigid or may be flexible (resilient), or slightly flexible (semi-rigid). Each tile tiles are typically is made as one of the following kinds: as a laminate floor panel; as a so-called "resilient floor panel"; a "LVT" (luxury vinyl tile) panel or "VCT panel" (vinyl composition tile) or comparable thereto panel on the basis of another synthetic material than vinyl; a floor panel with a first synthetic material-based, preferably foamed, substrate layer (base layer), with thereon a preferably thinner second substrate layer (second base layer) of or on the basis of vinyl or another synthetic material; as a floor panel with a hard synthetic material-based substrate.

It is preferred that the tile comprise one-piece coupling profiles, and in particular with one-piece vertically active coupling profiles, such by applying certain structural features and/or material characteristics and/or designs of the coupling profiles. The coupling profiles are preferably an integral part of each tile, and are typically made of one or more material layers which constitute the tile body. Preferably, the first coupling profile and the third coupling profile are configured for locking together tiles both vertically and horizontally. Preferably, the second coupling profile and the third coupling profile are configured for locking together tiles both vertically and horizontally. Since the first coupling profile is configured to be coupled to the third coupling profile by means of a turning movement, also referred to as a rotational movement or angling down movement, and since the second coupling profile is configured to be coupled to the third coupling profile by means of a fold-down movement and/or vertical movement, also referred to as a scissoring movement or zipping movement, the tiles of the tile system according to the invention can still be installed by using the user-friendly fold-down installation technology. The advantages achieved by the couplings thus in general lie in an improved tile with improved coupling profiles, wherein the advantage of a simple manufacture, by making use of easy to manufacture coupling profiles, namely, because they do not necessarily have to make use of separate connection pieces, the advantage that the tiles preferably can be installed according to the user-friendly fold-down principle, and the advantage of offering a relatively reliable and durable coupling, are combined.

In a preferred embodiment, at least one second locking element of the second coupling profile is provided at the second downward flank of the second coupling profile, and wherein at least one third locking element of the third coupling profile is provided at a distal side of the lower lip facing away from the third recess and/or a distal side of the upward locking element facing away from the third recess. It is commonly favourable to positioning at least one second locking elements and at least one third locking element at the predefined locations, since at these locations there is relatively much space, which allows the design of the locking elements to be more robust, which will be in favour of the vertical locking effect.

In a preferred embodiment, at least one second locking element of the second coupling profile is provided at a distal side of the downward tongue facing away from the second downward recess, and wherein at least one the third locking element of the third coupling profile is provided at a side of the upper lip, in coupled condition facing said distal side of the downward tongue of the second coupling profile of an adjacent tile. This alternative positioning of the locking elements has the advantage that the locking elements are positioned close to the upper seam formed between adjacent tiles, which contributes to the stabilization of said seam, and which counteracts that tiles will vertically shift with respect to each other close to the seam. It is indicated that this alternative positioning of the locking elements may be combined with the positioning of the locking elements described in the previous paragraph, in case a plurality of second locking elements and a plurality of third locking elements are applied. More preferably, the co-action between the second locking element and the third locking element for creating a vertical locking effect in coupled condition of two tiles, defines a tangent T1 which encloses an angle A1 with a plane defined by the tile, which angle A1 is smaller than an angle A2 enclosed by said plane defined by the tile and a tangent T2 defined by a co-action between an inclined part of a proximal side of the upward locking element facing toward the third recess and an inclined part of a proximal side of the downward tongue facing toward the second downward flank. Here, preferably, the greatest difference between angle A1 and angle A2 is situated between 5 and 20 degrees. It is preferable that said second locking element and said third locking element are positioned closer to the upper side of the tile compared to an upper side of the upward locking element. This will reduce the maximum deformation of one or more coupling profiles, whereas the connection process and deformation process can be executed in successive steps. Less deformation leads to less material stress which is in favour of the life span of the coupling profiles and hence of the tile(s).

The first coupling profile comprises at least one first locking element configured to face, and preferably co-act with, the third locking element of the third coupling profile of an adjacent tile in coupled condition. The presence of this at least one first locking element and the co-action of this first locking element with the third locking element in coupled condition further improves the stability of the coupling between the first coupling profile and the third coupling profile. Additionally, at least one first locking element of the first coupling profile is provided at the first downward flank of the first coupling profile, and wherein at least one third locking element of the third coupling profile is provided at a distal side of the lower lip facing away from the third recess and/or a distal side of the upward locking element facing away from the third recess. It is however also imaginable, optionally in addition to the aforementioned positioning of the first locking element, that at least one first locking element of the first coupling profile is provided at a distal side of the first coupling profile, being located above at least a part of the sideward tongue, and wherein at least one the third locking element of the third coupling profile is provided at a side of the upper lip, in coupled condition facing said distal side of the first coupling profile of an adjacent tile.

In a preferred embodiment, at least a part of the proximal side of the upward locking element of the third coupling profile, facing the third recess, is upwardly inclined in a direction away from the upper lip, preferably in such a way that an angle is enclosed with the normal perpendicular to the plane defined by each tile wherein said angle is situated between 0 and 60 degrees, in particular between 0 and 45 degrees. This inclination results in an open third recess which facilitates insertion both of the sideward tongue and of the downward tongue.

Preferably, at least a part of the proximal side of the downward tongue of the second coupling profile, facing the second downward recess, is downwardly inclined in a direction away from the second downward flank, preferably in such a way that an angle is enclosed with the normal perpendicular to the plane defined by each tile wherein said angle is situated between 0 and 60 degrees, in particular between 0 and 45 degrees. Preferably, at least a part of the proximal side of the sideward tongue of the first coupling profile, facing the first downward recess, is downwardly inclined in a direction away from the first downward flank, preferably in such a way that an angle is enclosed with the normal perpendicular to the plane defined by each tile wherein said angle is situated between 0 and 60 degrees, in particular between 0 and 45 degrees. By applying a corresponding inclination, a more complementary shape is given to the first coupling profile and/or second coupling profile, which normally results in a more stable coupling between the first and third coupling profiles and between the second and third coupling profiles.

In an alternative embodiment, at least a part of the proximal side of the upward locking element of the third coupling profile, facing the third recess, is upwardly inclined in a direction towards the upper lip, preferably in such a way that an angle is enclosed with the normal perpendicular to the plane defined by each tile wherein said angle is situated between 0 and 60 degrees, in particular between 0 and 45 degrees. This inward inclination leads to a (slightly) closed third recess, wherein the upward locking element may be used to hook around or clamp around the sideward tongue and/or the downward tongue once inserted in said third recess. This is in particularly possible in case at least a part of the proximal side of the downward tongue of the second coupling profile, facing the second downward recess, is downwardly inclined in a direction towards the second downward flank, preferably in such a way that an angle is enclosed with the normal perpendicular to the plane defined by each tile wherein said angle is situated between 0 and 60 degrees, in particular between 0 and 45 degrees. And the aforementioned gripping around effect and/or clamping effect of the upward locking element can for example also be achieved in case at least a part of the proximal side of the sideward tongue of the first coupling profile, facing the first downward recess, is downwardly inclined in a direction towards the first downward flank, preferably in such a way that an angle is enclosed with the normal perpendicular to the plane defined by each tile wherein said angle is situated between 0 and 60 degrees, in particular between 0 and 45 degrees.

Preferably, a first transition zone between the proximal side of the sideward tongue of the first coupling profile and a lower side of the sideward tongue of the first coupling profile is curved. This curved first transition zone may be used to guide the sideward tongue into the third recess during coupling of adjacent tiles. It is also imaginable that a second transition zone between the proximal side of the downward tongue of the second coupling profile and a lower side of the downward tongue of the second coupling profile is curved. This curved second transition zone may be used to guide the downward tongue into the third recess during coupling of adjacent tiles. A third transition zone between the proximal side of the upward locking element of the third coupling profile and an upper side of the upward locking element of the third coupling profile is preferably (also) curved to facilitate insertion of the downward tongue and the sideward tongue into the third recess.

Preferably, at the lower side of the lower lip of the third coupling profile, a recess is present, which extends up to the distal end of the lower lip and which allows a bending of the lower lip in downward direction. Bending of the lower lip in downward direction allows the third recess to widen during coupling, which will facilitate insertion of the sideward tongue and the downward tongue into the third recess. Dependent on the specific design of the coupling profiles, the lower lip may remain in bended state in a coupled condition of adjacent tiles. To this end, the first coupling profile and the third coupling profile may be configured such that in coupled condition a so-called pretension is existing, which forces the respective tiles at the respective first edge and third edge towards each other, wherein this preferably is performed by applying overlapping contours. And to this end, the second coupling profile and the third coupling profile may (also) be configured such that in coupled condition a so-called pretension is existing, which forces the respective tiles at the respective second edge and third edge towards each other, wherein this preferably is performed by applying overlapping contours. The pretension will commonly be the result of a deformation, either an elastic bending or an elastic compression, or a combination of both. The pretension will typically improve the mutually locking and coupling of cooperating coupling profiles.

The pretension is preferably realized by using overlapping contours of matching coupling profiles, in particular overlapping contours of the downward tongue and the third recess and/or overlapping contours of the upward locking element and the first and/or second downward recess. Overlapping contours doesn't mean that the complete contour should overlap, and merely requires that at least of part of the (outer) contour of the first and/or second coupling profile overlaps with at least a part of the (outer) contour of the third coupling part. The contours are typically compared by considering the contours of the first coupling part and the second coupling part from a side view (or cross-sectional view). By applying overlapping contours, the first and/or second coupling profiles and/or the third coupling profile will typically remain (elastically) deformed, in particular squeezed and/or bent, in a coupled state, provided the desired stability of the coupling. Normally, with overlapping contours the downward tongue will be (slightly) oversized with respect to the third recess, and/or the upward locking element will be (slightly) oversized with respect to the first and/or second downward recess. However, it should be understood that overlapping contours may also be realized in another manner, for example by applying overlapping (first, second, and/or third) locking elements.

In a preferred embodiment, the contour of the first coupling profile part which is configured to enclose the upward locking element of the third coupling profile is substantially identical to the (corresponding) contour of the second coupling profile part which is configured to enclose the upward locking element of the third coupling profile. The contour of a remaining part of the first coupling profile and the contour of a remaining part of the second coupling profile are typically mutually distinctive. The contact surface between the first coupling profile and the third coupling profile, in coupled condition, is preferably larger than the contact surface between the second coupling profile and the third coupling profile, in coupled condition. Preferably, the connection (coupling) between the first coupling profile and the third coupling profile leads to a firmer engagement per unit edge length in the longitudinal direction of the third recess and parallel to the plane of the tile(s) than the connection (coupling) between the second coupling profile and the third coupling profile.

During coupling of the tiles, the upward locking element may be (elastically) deformed, in particular squeezed and/or bent. Bending will take place from its initial position (slightly) in outward direction, away from the upper lip. A bent state of the upward locking element may remain in the coupled state of two tiles. The bending angle of the proximal side of the upward tongue, facing the upward flank, will commonly be restricted and situated in between 0 and 2 degrees.

It is imaginable, and even preferable, that the second coupling profile and the third coupling profile are configured such that in coupled condition a so-called pretension is existing, while the first coupling profile and the third coupling profile are configured such a coupled condition is substantially free of pretension. This (hybrid) embodiment may facilitate coupling of the tiles.

In an alternative embodiment, the first coupling profile and the third coupling profile are configured such that a coupled condition is substantially free of pretension between the first coupling profile and the third coupling profile. The same may apply between the second coupling profile and the third coupling profile, wherein the second coupling profile and the third coupling profile may be configured such that a coupled condition is substantially free of pretension between the second coupling profile and the third coupling profile. This can typically be achieved in case the contour of the first coupling profile and/or the second coupling profile fits into or with the contour of the third coupling profile, preferably without play to counteract the risk of the occurrence of creaking noises.

In a preferred embodiment, the first coupling profile and the third coupling profile are configured such that in coupled condition a plurality of, preferably at least three, distant contact zones are present, wherein in between each pair of adjacent contact zones a space remains. Preferably, the second coupling profile and the third coupling profile are configured such that in coupled condition a plurality of, preferably at least three, distant contact zones are present, wherein in between each pair of adjacent contact zones a space remains. By applying one or more intentional (air) gaps between the coupling profiles in coupled condition. These, the created clearance(s) or gap(s) is/are advantageous for the purpose of absorbing expansion of the tile, for instance resulting from environmental temperature changes, and/or for accumulation of dust, in particular environmental dust or dust created during production of the tile(s).

Typically, the first edge and the third edge, in coupled condition, define a first closing surface defined as a first vertical plane (joint plane) through the upper edges of the coupled tiles or at least the location where the tiles come together at the upper side of the tiles. Preferably, the first coupling profile and the third coupling profile are configured such that in coupled condition, each of the sideward tongue and the third recess extends through said first vertical plane (joint plane). By "extending through" is meant that a part of the sideward tongue is located at one side of the first vertical plane and another part of the sideward tongue is located at an opposite side of the first vertical plane. The same applies to the third recess. The lower lip which limits the lower side of the third recess typically extends beyond the upper lip. Preferably the upper lip defines said vertical plane (joint plane) of two tiles in coupled condition. Preferably, the upward locking element is positioned at a distance from said vertical plane. Here, the upward locking element and the upper lip are typically positioned at opposing sides of the joint plane. Here, the possible difference between the upper lip and lower lip which border the third recess, measured in the plane of the tile is preferably smaller than one time the total thickness of the tile. This will save material loss during manufacturing of the tile. However, in another preferred embodiment, the difference between the upper lip and the lower lip, measured in the plane of the tile is larger than 1.0 times, and is preferably at least 1.25 times, the thickness of the tile. In this embodiment, the lower lip is relatively long having as advantage that the third recess and the matching sideward tongue and downward tongue can be dimensioned relatively large (compared to the situation in which a relatively short lower lip is applied), which is beneficial for the robustness, stability and durability of the couplings achieved by means of the coupling profiles of adjacent tiles.

Typically, (also) the second edge and the third edge, in coupled condition, define a second closing surface defining a second vertical plane through the upper edges of the coupled tiles or at least the location where the tiles come together at the upper side of the tiles. Preferably, the second coupling profile and the third coupling profile are configured such that in coupled condition, the downward tongue is positioned at one side of the second vertical plane, and the third recess extends through said second vertical plane. This means that the one outer end of the third recess, typically also referred to as the tip of the third recess, remains empty when the second coupling profile and the third coupling profile are mutually coupled.

A distal side of the downward tongue, facing away from the second downward recess, preferably comprises at least a vertical upper wall part adjacent to the upper side of the tile, and, adjacent to and located below said vertical wall part, an angled wall part that angles inward toward a chamfered and/or curved lower wall part of said distal side of the downward tongue. The lower wall part of said distal side is preferably connected to a lower side of the downward tongue. Preferably, in between said angled wall part and said lower wall part an intermediate vertical wall part is situated. This intermediate vertical wall part allows the downward tongue to be design in a more robust manner. This specific shape is commonly the most preferred shape during production, and provides said distal side of the downward tongue both a guiding function (defined by the lower wall part) for guiding the downward tongue into the third recess, and a closing function for creating a closed seem between the upper edges of adjacent panels (defined by the upper wall part). One of the aforementioned wall parts, and preferably the upper wall part of the distal side of the downward tongue may be provided with a second locking element to realize and/or improve a vertical locking between coupled tiles.

In a preferred embodiment, a lower side of the sideward tongue of the first coupling profile, in coupled condition of two tiles, is supported by a lower surface of the upward third recess of the third coupling profile. The lower surface of the third recess is defined by an upper side of the lower lip. This supporting contact preferably causes a fixation in the mutual position of the first coupling profile and the third coupling profile. The second coupling profile and third coupling profile preferably cooperate under tension at this supporting contact zone or supporting contact point. The same is preferably applied with respect to the second coupling profile and the third coupling profile. To this end, a lower side of the downward tongue of the second coupling profile, in coupled condition of two tiles, is supported by a lower surface of the (upward) third recess of the third coupling profile. This supporting contact preferably causes a fixation in the mutual position of the second coupling profile and the third coupling profile. The coupling second profile and coupling third profile preferable cooperate under tension at this supporting contact zone or supporting contact point. A stable support of the sideward tongue and the downward tongue by the lower lip, in coupled condition, may further stabilize the coupling between the coupling profiles, and may also counteract the risk of the occurrence of creaking noises (squeaking).

In a preferred embodiment, in a coupled condition of tiles, the first downward flank of the first coupling profile and a distal side of the upward locking element and/or lower lip of the third coupling profile, facing the first downward flank, are positioned at a distance from each other. Preferably, in a coupled condition of tiles, the second downward flank of the second coupling profile and a distal side of the upward locking element and/or lower lip of the third coupling profile, facing the second downward flank, are positioned at a distance from each other. This intermediate (vertical) space between adjacent tiles creates some space for the lower lip and the upward locking element to (slightly) deform during coupling, and optionally to remain in a (slightly) deformed state in coupled condition of the tiles. This technical effect typically facilitates coupling and may also improve the stability of the coupling.

At least a part of, and preferably the complete, upper side of the upward locking element is inclined downwardly in a direction facing way from the upper lip of the third coupling profile. Preferably, at least a part of, and preferably the complete, upper side of the first downward recess is inclined downwardly towards the first downward flank. Preferably, both inclinations mutually enclose an angle between (and including) 0 and 5 degrees. The inclination of the upper side of the upward locking element is preferably situated between 15 and 45 degrees, more preferably between 25 and 35 degrees, and is most preferably about 30 degrees, with respect to a horizontal plane (being a plane defined by the tile). The inclination of the upper side of the upward locking element is preferably constant, which means the upper side has a substantially flat orientation. Preferably, an upper side of the first downward recess and/or the second downward recess has a, preferably likewise (compared to the inclination of the upper side of the upward locking element) inclining orientation, which is more preferably upward in the direction of the sideward tongue and/or in the direction of the downward tongue. A first lower surface of a first bridge connecting the downward tongue to the core (main body) of the tile is defined by the upper side of the first downward recess (or vice). A second lower surface of a second bridge connecting the downward tongue to the core (main body) of the tile is defined by the upper side of the second downward recess (or vice).

Applying an inclined upper side of the first downward recess will result in a varying thickness of the first and/or second bridge, as seen from the core in the direction of the downward tongue. This position-dependent bridge thickness, wherein the bridge thickness is preferably relatively large close to the core and relatively small close to the downward tongue, bridge thickness has multiple advantages. The thicker part of the first and/or second bridge, close to the core, provides the bridge more and sufficient strength and robustness, while the thinner part of the bridge, close to the sideward tongue and/or downward tongue, forms the weakest point of the bridge and will therefore be decisive for the location of first deformation (pivoting point) during coupling. Since this point of deformation is located close to the sideward tongue and/or downward tongue the amount of material to be deformed to be able to insert the sideward tongue and/or downward tongue into the third recess can be kept to a minimum. Less deformation leads to less material stress which is in favour of the life span of the coupling profile(s) and hence of the tile(s). In the coupled state of adjacent tiles, the upper side of the first downward recess or second downward recess could be at least partially, and preferably substantially completely, supported by the upper side of the upward locking element, which provides additionally strength to the coupling as such. To this end, it is advantageous that the inclination of the upper side of the first downward recess and/or second downward recess substantially corresponds to the inclination of the upper side of the upward locking element. This means that the inclination of the upper side of the first downward recess and/or second downward recess is preferably situated between 15 and 45 degrees, more preferably between 25 and 35 degrees, and is most preferably about 30 degrees, with respect to a horizontal plane. This inclination may be either flat or rounded, or eventually hooked.

In coupled condition of two tiles, the (inclined or horizontal) upper side of the upward locking element of the third coupling profile is preferably positioned at a distance from the (inclined or horizontal) upper side of the first downward recess of the first coupling profile due to facilitate coupling and to allow dust to accumulate within the space created directly above the upward locking element.

In a preferred embodiment, an upper side of the upward locking element is positioned at a lower level than the upper lip of the third coupling profile. This allows sufficient space to dimension the first coupling profile and the second coupling profile in a relatively robust manner, which is in favour of the strength of the first coupling profile and the second coupling profile. Moreover, this configuration facilitates insertion of the sideward tongue and the downward tongue into the third recess.

The third locking element preferably comprises at least one outward bulge, and that the second locking element and—if applied—the first locking element comprise(s) at least one first locking groove or second locking groove, respectively, which outward bulge is adapted to be at least partially received in the first locking groove and second locking groove of an adjacent coupled tile for the purpose of realizing a locked coupling, preferably a vertically locked coupling. The third locking element and the second locking element preferably have a substantially complementary shape. Alternatively, the third locking element comprises at least one third locking groove, and the second locking element and—if applied—the first locking element comprises at least one outward bulge (ridge), which outward bulge is adapted to be at least partially received in said locking groove of an adjacent coupled tile for the purpose of realizing a locked coupling. It is also conceivable that the first locking element (if applied), the second locking element and the third locking element are not formed by a bulge-groove combination, but by another combination of co-acting profiled surfaces and/or high-friction contact surfaces. In this latter embodiment, the at least one locking element of the first, second, or third locking element may be formed by a (flat of otherwise shaped) contact surface composed of a, optionally separate, plastic material configured to generate friction with the other locking element of another tile in engaged (coupled) condition. Examples of plastics suitable to generate friction include:

- Acetal (POM), being rigid and strong with good creep resistance. It has a low coefficient of friction, remains stable at high temperatures, and offers good resistance to hot water;
- Nylon (PA), which absorbs more moisture than most polymers, wherein the impact strength and general energy absorbing qualities actually improve as it absorbs moisture. Nylons also have a low coefficient of friction, good electrical properties, and good chemical resistance;
- Polyphthalamide (PPA). This high performance nylon has through improved temperature resistance and lower moisture absorption. It also has good chemical resistance;
- Polyetheretherketone (PEEK), being a high temperature thermoplastic with good chemical and flame resistance combined with high strength. PEEK is a favourite in the aerospace industry;
- Polyphenylene sulfide (PPS), offering a balance of properties including chemical and high-temperature resistance, flame retardance, flowability, dimensional stability, and good electrical properties;
- Polybutylene terephthalate (PBT), which is dimensionally stable and has high heat and chemical resistance with good electrical properties;
- Thermoplastic polyimide (TPI) being inherently flame retardant with good physical, chemical, and wear-resistance properties.
- Polycarbonate (PC), having good impact strength, high heat resistance, and good dimensional stability. PC also has good electrical properties and is stable in water and mineral or organic acids; and
- Polyetherimide (PEI), maintaining strength and rigidity at elevated temperatures. It also has good long-term heat resistance, dimensional stability, inherent flame retardance, and resistance to hydrocarbons, alcohols, and halogenated solvents.

Typically, though not necessarily, the third locking element is positioned at a distal side of the lower lip and/or the upward locking element, and at a distance both from a lower side of the lower lip and an upper side of the upward locking element. This allows the third locking element to co-act with a relatively large surface area, and therefore intensively, with a complementary first locking element and/or second locking element.

Typically, the upward locking element protrudes in vertical direction (i.e. a direction perpendicular to the plane defined by the panel) with respect to the lower lip. Preferably, the effective height of the upward locking element (in said vertical direction) is defined as the maximum (vertical) distance between a highest location of the upward locking element and a lowest location of the lower lip. Preferably, the effective height of the upward locking element is at least 20%, more preferably at least 25%, and even more preferably at least 30% of the panel thickness. Preferably, the combined thickness of the lower lip and the upward locking element is at least 50% of the panel thickness. These preferred features all aim to improve the horizontal locking effect between two panels in coupled condition.

Each coupling profile is preferably free from hook and loop fasteners and/or adhesive connections. Each tile preferably does not comprise any other coupling profile than at least one first coupling profile, at least one second coupling profile, and at least one, preferably at least two, third coupling profile(s). Preferably, each coupling profile is provided with chamfers, such as bevels, at or near the upper side of the tiles. The presence of the chamfers, such as bevels, typically make seam gaps less visible. The presence of chamfers lead to the situation that when two tiles are brought together for attachment, a valley or V-shaped recess is formed. Preferably, the tapered or bevelled edges are at an angle of from about 15° to about 55°, and more preferably at about a 17° angle. Also, the width of the bevelled or tapered edge is about 1.0 mm to about 7.0 mm.

When realizing a chevron pattern, it is advantageous in case the system comprises two different types of tiles (A and B respectively), and wherein the coupling profiles of one type of tile along are arranged in a mirror-inverted manner relative to the corresponding coupling profiles of the other type of tile. To this end, it is preferred in case the system comprises a plurality of tiles having a parallelogramical shape, wherein said tiles are configured to being joined in a chevron pattern, wherein two pairs of adjacent edges enclose an acute angle, and wherein two pairs of other adjacent edges enclose a obtuse angle. The acute angle is typically situated between 30 and 60 degrees, and is preferably substantially 45 degrees. The obtuse angle is typically situated between 120 and 150 degrees, and is preferably substantially 135 degrees. Preferably, at least one parallelogramical tile (A) has a configuration, wherein the edges are arranged, as seen from a top view in a clockwise direction, in the order: a first edge, a third edge, another third edge, and a second edge, and wherein at least one parallelogramical tile (B) has a configuration, wherein the edges are arranged, as seen from a top view in a clockwise direction, in the order: a first edge, a second edge, a third edge, and another third edge. Distinctive visual markings, for example coloured labels, symbolic labels, (pre-attached) differently coloured backing layers, and/or text labels, may be applied to different tile types to allow a user to easily recognize the different tiles types during installation. Preferably the visual markings are not visible in a coupled condition of the tiles (from a top view). A visual marking may, for example, be applied onto the upper side of the upward locking element and/or inside the third recess and/or inside the first or second downward recess. It is imaginable that the system according to the invention comprises more than two different types of tiles.

At least one tile, and preferably each tile, preferably comprises an upper substrate affixed—either directly or indirectly—to an upper side the base layer, wherein said upper substrate preferably comprises a decorative layer. The upper substrate is preferably at least partially made of at least one material selected from the group consisting of: metals, alloys, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres. Here, the vinyl monomer copolymers and/or homo-polymers are preferably selected from the group consisting of polyethylene, polyvinyl chloride (PVC), polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers, and derivates thereof. The upper substrate most preferably comprises polyethylene or polyvinyl chloride (PVC). The polyethylene can be low density polyethylene, medium density polyethylene, high density polyethylene or ultra-high density polyethylene. The upper substrate layer can also include filler materials and other additives that improve the physical properties and/or chemical properties and/or the processability of the product. These additives include known toughening agents, plasticizing agents, reinforcing agents, anti-mildew (antiseptic) agents, flame-retardant agents, and the like. The upper substrate typically comprises a decorative layer and an abrasion resistant wear layer covering said decorative layer, wherein a top surface of said wear layer is the top surface of said tile, and wherein the wear layer is a transparent material, such that decorative layer is visible through the transparent wear layer.

Preferably, at least one tile, and preferably each tile, comprises an upper substrate affixed—either directly or indirectly—to an upper side of at least one base layer, wherein said upper substrate preferably comprises a veneer layer. Said veneer layer preferably has a Mohs hardness of greater than 3. Said veneer layer preferably has a thickness of between 2 and 8 mm. Said veneer layer being dimensioned so as not to overlie the supporting base layer and/or the at least one or more coupling profiles applied. The veneer layer is preferably composed of a material selected from the group consisting of natural stone, marble, granite, slate, glass, and ceramics. More preferably, the veneer layer is a ceramic of a type selected from the group consisting of Monocuttura ceramic, Monoporosa ceramic, porcelain ceramic, or multi-casted ceramic. Preferably, the veneer layer has a breaking modulus greater than 10 N/mm2, more preferably greater than 30 N/mm2.

The thickness of the upper substrate typically varies from about 0.1 to 3.5 mm, preferably from about 0.5 to 3.2 mm, more preferably from about 1 to 3 mm, and most preferably from about 2 to 2.5 mm. The thickness ratio of the base layer to the upper substrate commonly varies from about 1 to 15:0.1 to 3.5, preferably from about 1.5 to 10:0.5 to 3.2, more preferably from about 1.5 to 8:1 to 3, and most preferably from about 2 to 8:2 to 2.5, respectively.

Each tile may comprise an adhesive layer to affix the upper substrate, directly or indirectly, onto the base layer. The adhesive layer can be any well-known bonding agent or binder capable of bonding together the upper substrate and the base layer, for example polyurethanes, epoxy resins, polyacrylates, ethylene-vinyl acetate copolymers, ethylene-acrylic acid copolymers, and the like. Preferably, the adhesive layer is a hot-melt bonding agent.

The decorative layer or design layer, which may be part of the upper substrate as mentioned above, can comprise any suitable known plastic material such as a known formulation of PVC resin, stabilizer, plasticizer and other additives that are well known in the art. The design layer can be formed with or printed with printed patterns, such as wood grains, metal or stone design and fibrous patterns or three-dimensional figures. Thus the design layer can provide the tile with a three dimensional appearance that resembles heavier products such as granite, stone or metal. The thickness of the design layer typically varies from about 0.01 to 0.1 mm, preferably from about 0.015 to 0.08 mm, more preferably from about 0.2 to 0.7 mm, and most preferably from about 0.02 to 0.5 mm. The wear layer that typically forms the upper surface of the tile can comprise any suitable known abrasion-resistant material, such as an abrasion-resistant macromolecular material coated onto the layer beneath it, or a known ceramic bead coating. If the wear layer is furnished in layer form, it can be bonded to the layer beneath it. The wear layer can also comprise an organic polymer layer and/or inorganic material layer, such as an ultraviolet coating or a combination of another organic polymer layer and an ultraviolet coating. For example, an ultraviolet paint capable of improving the surface scratch resistance, glossiness, antimicrobial resistance and other properties of the product. Other organic polymers including polyvinyl chloride resins or other polymers such as vinyl resins, and a suitable amount of plasticizing agent and other processing additives can be included, as needed.

In a preferred embodiment, at least one tile comprises a plurality of strip shaped upper substrates directly or indirectly affixed to an upper side the base layer, wherein said upper substrate are arranged side by side in the same plane, preferably in a parallel configuration. Here, the plurality of upper substrates preferably substantially completely cover the upper surface of the base layer, and more preferably extend from the first edge to the second edge of the tile. Each of the plurality of upper substrates comprises a decorative layer, wherein the decorative layers of at least two adjacently arranged upper substrates preferably have different appearances. The application of a plurality of strip shaped upper substrates, are arranged side by side in the same plane and directly or indirectly affixed to the base layer will create the attractive aesthetical effect that the chevron tiles is defined by the strip shaped upper substrates as such, while having the advantages that during installation merely the tiles as such will have to be coupled rather than the strip shaped upper substrate, which would be time-consuming and expensive.

Preferably, the base layer comprises at least one foaming agent. The at least one foaming agent takes care of foaming of the base layer, which will reduce the density of the base layer. This will lead to light weight tiles, which are lighter weight in comparison with tile which are dimensionally similar and which have a non-foamed base layer. The preferred foaming agent depends on the (thermo)plastic material used in the base layer, as well as on the desired foam ratio, foam structure, and preferably also the desired (or required) foam temperature to realise the desired foam ratio and/or foam structure. To this end, it may be advantageous to apply a plurality of foaming agents configured to foam the base layer at different temperatures, respectively. This will allow the foamed base layer to be realized in a more gradual, and more controller manner. Examples of two different foaming agents which may be present (simultaneously) in the base layer are azidicarbonamide and sodium bicarbonate. In this respect, it is often also advantageous to apply at least one modifying agent, such as methyl methacrylate (MMA), in order to keep the foam structure relatively consistent throughout the base layer.

Polymer materials suitable for forming the base layer may include polyurethane (PUR), polyamide copolymers, polystyrene (PS), polyvinyl chloride (PVC), polypropylene, polyethylene terephthalate (PET), Polyisocyanurate (PIR), and polyethylene (PE) plastics, all of which have good moulding processability. The at least one polymer included in the base layer may either may be solid or may be foamed (expanded). Preferably, chlorinated PVC (CPVC) and/or chlorinated polyethylene (CPE) and/or another chlorinated thermoplastic material is/are used to further improve the hardness and rigidity of the base layers, and of the tiles as such, reducing the vulnerability of the pointed vertexes of each tile, which makes the tile even more suitable to be used as parallelogrammatic/rhombic tile for realizing chevron patterns. Polyvinyl chloride (PVC) materials are especially suitable for forming the base layer because they are chemically stable, corrosion resistant, and have excellent flame-retardant properties. The plastic material used as plastic material in the base layer is preferably free of any plasticizer in order to increase the desired rigidity of the base layer, which is, moreover, also favourable from an environmental point of view.

The base layer may also at least partially be composed of a, preferably PVC-free, thermoplastic comprising composition. This thermoplastic composition may comprise a polymer matrix comprising (a) at least one ionomer and/or at least one acid copolymer; and (b) at least one styrenic thermoplastic polymer, and, optionally, at least one filler. An ionomer is understood as being a copolymer that comprises repeat units of electrically neutral and ionized units. Ionized units of ionomers may be in particular carboxylic acid groups that are partially neutralized with metal cations. Ionic groups, usually present in low amounts (typically less than 15 mol % of constitutional units), cause micro-phase separation of ionic domains from the continuous polymer phase and act as physical crosslinks. The result is an ionically strengthened thermoplastic with enhanced physical properties compared to conventional plastics.

The base layer may be made of a composite of at least one polymer and at least one non-polymeric material. The composite of the base layer preferably comprises one or more fillers, wherein at least one filler is selected from the group consisting of: talc, chalk, wood, calcium carbonate, titanium dioxide, calcined clay, porcelain, a(nother) mineral filler, and a(nother) natural filler. The filler may be formed by fibres and/or may be formed by dust-like particles. Here, the expression "dust" is understood as small dust-like particles (powder), like wood dust, cork dust, or non-wood dust, like mineral dust, stone powder, in particular cement. The average particle size of the dust is preferably between 14 and 20 micron, more preferably between 16 and 18 micron. The primary role of this kind of filler is to provide the base layer, and the parallelogrammatic/rhombic tile(s) as such, sufficient hardness. This will allow the tiles, including their—commonly relatively vulnerable—pointed vertexes, to realize chevron patterns in a reliable and durable manner. Moreover, this kind of filler will typically also improve the impact strength of the base layer and of the tile(s) as such. The weight content of this kind of filler in the composite is preferably between 35 and 75%, more preferably between 40 and 48% in case the composite is a foamed composite, and more preferably between 65 and 70% in case the composite is a non-foamed (solid) composite.

In an alternative configuration of the tile system according to the invention, each tile comprises a substantially rigid base layer at least partially made of a non-foamed (solid) composite comprising at least one plastic material and at least one filler. A solid base layer may lead to an improved tile strength, and hence a reduced vulnerability of the pointed vertexes, and may further improve the suitability to use the tiles to realize a chevron pattern. A drawback of applying a solid composite in the base layer instead of a foamed composite in the base layer is that the tile weight will increase (in case base layers of identical thicknesses would be applied), which may lead to higher handling costs, and higher material costs.

Preferably, the composite of the base layer comprises at least one filler of the base layer is selected from the group consisting of: a salt, a stearate salt, calcium stearate, and zinc stearate. Stearates have the function of a stabilizer, and lead to a more beneficial processing temperature, and counteract decomposition of components of the composite during processing and after processing, which therefore provide long-term stability. Instead of or in addition to a stearate, for example calcium zinc may also be used as stabilizer. The weight content of the stabilizer(s) in the composite will preferably be between 1 and 5%, and more preferably between 1.5 and 4%.

The composite of the base layer preferably comprises at least one impact modifier comprising at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the base layer and can therefore also be seen as toughening agent, which further reduces the risk of breakage. Often, the modifier also facilitates the production process, for example, as already addressed above, in order to control the formation of the foam with a relatively consistent (constant) foam structure. The weight content of the impact modifier in the composite will preferably be between 1 and 9%, and more preferably between 3 and 6%. Preferably, the substantially complete base layer is formed by either a foamed composite or a non-foamed (solid) composite. At least one plastic material used in the base layer is preferably free of any plasticizer in order to increase the desired rigidity of the base layer, which is, moreover, also favourable from an environmental point of view.

The base layer and/or another layer of the tile may comprise wood-based material, for example, MDF, HDF, wood dust, prefabricated wood, more particularly so-called engineered wood. This wood-based material may be part of a composite material of the base layer.

The density of the base layer typically varies from about 0.1 to 1.5 grams/cm3, preferably from about 0.2 to 1.4 grams/cm3, more preferably from about 0.3 to 1.3 grams/cm3, even more preferably from about 0.4 to 1.2 grams/cm3, even more preferably from about 0.5 to 1.2 grams/cm3, and most preferably from about 0.6 to 1.2 grams/cm3.

The polymer used in the base layer and/or the base layer as such preferably has an elastic modulus of more than 700 MPa (at a temperature of 23 degrees Celsius and a relative humidity of 50%). This will commonly sufficiently rigidity to the base layer, and hence to the parallelogrammatic/rhombic tile as such.

The base layer preferably layer has a thickness of at least 3 mm, preferably at least 4 mm, and still more preferably at least 5 mm. It is imaginable that each tile comprises a plurality of base layers. Different base layers may have either identical compositions or different compositions.

The density of the base layer preferably varies along the height of the base layer. This may positively influence the acoustic (sound-dampening) properties of the tiles as such. Preferably, at a top section and/or a bottom section of a foamed base layer a crust layer may be formed. This at least one crust layer may form integral part of the base layer. More preferably, both the top section and the bottom section of the base layer form a crust layer enclosing the foam structure. The crust layer is a relatively closed (reduced porosity, preferably free of bubbles (cells)), and hence forms a relatively rigid (sub)layer, compared to the more porous foam structure. Commonly, though not necessary, the crust layer is formed by sealing (searing) the bottom and top surface of the core layer. Preferably the thickness of each crust layer is between 0.01 and 1 mm, preferably between 0.1 and 0.8 mm. A too thick crust will lead to a higher average density of the core layer which increases both the costs and the rigidity of the core layer. The thickness of the base layer (core layer) as such is preferably between 2 and 10 mm, more preferably between 3 and 8 mm, and is typically approximately 4 or 5 mm. Preferably, a top section and/or a bottom section of the (composite) base layer forms a crust layer having a porosity which is less than the porosity of the closed cell foam plastic material of the base layer, wherein the thickness of each crust layer is preferably between 0.01 and 1 mm, preferably between 0.1 and 0.8 mm.

Preferably, each tile comprises at least one backing layer affixed to a bottom side of the base layer, wherein said at least one backing layer at least partially made of a flexible material, preferably an elastomer. The thickness of the backing layer typically varies from about 0.1 to 2.5 mm. Non-limiting examples of materials whereof the backing layer can be made of are polyethylene, cork, polyurethane and ethylene-vinyl acetate. The thickness of a polyethylene backing layer is for example typically 2 mm or smaller. The backing layer commonly provides additional robustness and impact resistances to each tile as such, which increases the durability of the tiles. Moreover, the (flexible) backing layer may increase the acoustic (sound-dampening) properties of the tiles. In a particular embodiment, the base layer is composed of a plurality of separate base layer segments affixed to said at least one backing layer, preferably such that said base layer segments are mutually hingeable. The light-weight features of the tiles are advantageous for obtaining a secure bond when installing the tile on vertical wall surfaces. It is also especially easy to install the tile at vertical corners, such as at inside corners of intersecting walls, pieces of furniture, and at outside corners, such as at entry ways. An inside or outside corner installation is accomplished by forming a groove in the base layer of the tile to facilitate bending or folding of the tile.

Each tile may comprises at least one reinforcing layer. At least one reinforcing layer may be situated in between the base layer and the upper substrate. At least one reinforcing layer may be situated in between two base layers. The application of a reinforcing layer may lead to further improvement of the rigidity of the tiles as such. This may also lead to improvement of the acoustic (sound-dampening) properties of the tiles. The reinforcement layer may comprise a woven or non-woven fibre material, for example a glass fibre material. They may have a thickness of 0.2-0.4 mm. It is also conceivable that each tile comprises a plurality of the (commonly thinner) base layer stacked on top of each other, wherein at least one reinforcing layer is situated in between two adjacent base layers. Preferably, the density of the reinforcing layer is preferably situated between 1.000 and 2.000 kg/m3, preferably between 1.400- and 1.900 kg/m3, and more preferably between 1.400-1.700 kg/m3.

Preferably, at least a part of the first coupling profile and/or at least a part of second coupling profile and/or at least a part of the third coupling profile of each tile is integrally connected to the base layer. In this case one-piece tiles are formed, which are relatively easy and cost-efficient to produce.

The first coupling profile and/or the second coupling profile and/or the third coupling profile preferably allows deformation during coupling and uncoupling of tiles. At least a number of tiles is identical. It is also imaginable that at least a number of tiles have different sizes and/or different shapes. Apart from the already discussed parallelogramical shaped tiles for realizing chevron patterns, it is also imaginable that the tile system comprises different types of tiles (A and B respectively), wherein the size of a first type of tile (A) differs from the size of second type of tile (B). These A and B panels may e.g. have a rectangular and/or square shape. Distinctive visual markings may be applied to different tile types, preferably for installation purposes. To this end, distinctive visual markings are preferably applied to an upper side of third recess and/or an upper side of the upward locking element of the third coupling profile of each tile type.

The invention also relates to a tile covering, in particular floor covering, wall covering, ceiling covering and/or furniture covering, consisting of mutually coupled tiles according to the invention. The invention also relates to a tile for use in multi-purpose tile system according to the invention.

The invention moreover relates to the method of installing a tile system, in particular a floor tile system, preferably a tile system according to the present disclosure, comprising the steps of: a) positioning at least one first tile on a supporting surface, in particular a subfloor, b) providing at least one second tile to be coupled to said at least one first tile, c) selecting at least one coupling profile from the group consisting of (i) the first coupling profile of the second tile, and (ii) the second coupling profile of the second tile, to be coupled to at least one third coupling profile of at least one first tile; and/or selecting at least one coupling profile from the group consisting of (i) the first coupling profile of the first tile, and (ii) the second coupling profile of the first tile, to be coupled to at least one third coupling profile of at least one second tile; and d) coupling the at least one selected coupling profile of a said second tile or first tile, to the at least one third coupling profile of a first tile or second tile. Here, the first coupling profile and the third coupling profile are configured such that two of such tiles can be coupled to each other by means of a turning movement, and wherein the second coupling profile and the third coupling profile are configured such that the two of such tiles can be coupled to each other by means of a fold-down movement and/or a vertical movement. A second tile to be installed may be coupled simultaneously to more first tiles already positioned.

The ordinal numbers used in this document, like "first", "second", and "third" are used only for identification purposes. Hence, the use of the expressions "third locking element" and "second locking element" does therefore not necessarily require the co-presence of a "first locking element".

The tiles of the tile system according to the invention may also be referred to as panels. The base layer may also be referred to as core layer. The coupling profiles may also be referred to as coupling parts or as connecting profiles. By "complementary" coupling profiles is meant that these coupling profiles can cooperate with each other. However, to this end, the complementary coupling profiles do not necessarily have to have complementary forms. By locking in "vertical direction" is meant locking in a direction perpendicular to the plane of the tile. By locking in "horizontal direction" is meant locking in a direction perpendicular to the respective coupled edges of two tiles and parallel to or falling together with the plane defined by the tiles. In case in this document reference is made to a "floor tile" or "floor panel", these expressions may be replaced by expressions like "tile", "wall tile", "ceiling tile", "covering tile". In the context of this document, the expressions "foamed composite" and "foamed plastic material" (or "foam plastic material") are interchangeable, wherein in fact the foamed composite comprises a foamed mixture comprising at least one (thermos)plastic material and at least one filler (non-polymeric material).

The invention also relates to a multi-purpose tile system, in particular a floor tile system, comprising a plurality of multi-purpose tiles, in particular floor tiles, wherein the tiles, and preferably each tile, comprises at least one first edge having a first coupling profile comprising a sideward tongue extending in a direction substantially parallel to the upper side of the tile, at least one first downward flank lying at a distance from the sideward tongue, and a first downward recess formed between the sideward tongue and the first downward flank, at least one second edge having a second coupling profile comprising a downward tongue extending in a direction substantially perpendicular to the upper side of the tile, at least one second downward flank lying at a distance from the downward tongue, a second downward recess formed between the downward tongue and the downward flank, and preferably, at least one second locking element, at least one third edge, and preferably at least two third edges, each third edge having a third coupling profile comprising a third recess configured for accommodating at least a part of the sideward tongue of the first coupling profile of a further tile and at least a part of the downward tongue of a further tile, said third recess being defined by an upper lip and a lower lip, wherein said lower lip is provided with an upward locking element, and preferably, at least one third locking element, wherein the first coupling profile and the third coupling profile are configured such that two of such tiles can be coupled to each other at the first and third edges by means of a turning movement, wherein, in coupled condition at least a part of the sideward tongue of the first coupling profile of a tile is inserted into the third recess of the third coupling profile of an adjacent tile, and at least a part of the upward locking element of the third coupling profile is inserted into the first downward recess of the first coupling profile, and wherein the second coupling profile and the third coupling profile are configured such that the two of such tiles can be coupled to each other at the second and third edges by means of a fold-down movement and/or a vertical movement, wherein, in coupled condition at least a part of the downward tongue of the second coupling profile is inserted in the third recess of the third coupling profile, at least a part of the upward locking element of the third coupling profile is inserted in the second downward recess of the second coupling profile, and if applied, at least one second locking element is facing, and preferably co-acting with, at least one third locking element to realise a vertical locking effect, wherein at least a part of the proximal side of the upward locking element of the third coupling profile, facing the third recess, is upwardly inclined in a direction towards the upper lip, preferably in such a way that an angle is enclosed with the normal perpendicular to the plane defined by each tile wherein said angle is situated between 0 and 60 degrees, in particular between 0 and 45 degrees.

In this embodiment, the upward locking element of the third coupling profile can provide substantial locking between said third coupling profile and the first or second coupling profile. The use of further secondary locking elements such as a third and a second locking element may be omitted.

The invention will be elucidated on the basis of the following non-limitative exemplary embodiments described in the following clauses.

1. Multi-purpose tile system, in particular a floor tile system, comprising a plurality of multi-purpose tiles, in particular floor tiles, wherein the tiles, and preferably each tile, comprise:

- at least one first edge having a first coupling profile comprising:
  - a sideward tongue extending in a direction substantially parallel to the upper side of the tile,
  - at least one first downward flank lying at a distance from the sideward tongue, and
  - a first downward recess formed between the sideward tongue and the first downward flank,
- at least one second edge having a second coupling profile comprising:
  - a downward tongue extending in a direction substantially perpendicular to the upper side of the tile,
  - at least one second downward flank lying at a distance from the downward tongue,
  - a second downward recess formed between the downward tongue and the downward flank, and
  - preferably, at least one second locking element;
- at least one third edge, and preferably at least two third edges, each third edge having a third coupling profile comprising:
  - a third recess configured for accommodating at least a part of the sideward tongue of the first coupling profile of a further tile and at least a part of the downward tongue of a further tile, said third recess being defined by an upper lip and a lower lip, wherein said lower lip is provided with an upward locking element, and
  - preferably, at least one third locking element, wherein the first coupling profile and the third coupling profile are configured such that two of such tiles can be coupled to each other at the first and third edges by means of a turning movement, wherein, in coupled condition:

- at least a part of the sideward tongue of the first coupling profile of a tile is inserted into the third recess of the third coupling profile of an adjacent tile, and
- at least a part of the upward locking element of the third coupling profile is inserted into the first downward recess of the first coupling profile, and wherein the second coupling profile and the third coupling profile are configured such that the two of such tiles can be coupled to each other at the second and third edges by means of a fold-down movement and/or a vertical movement, wherein, in coupled condition:

at least a part of the downward tongue of the second coupling profile is inserted in the third recess of the third coupling profile, at least a part of the upward locking element of the third coupling profile is inserted in the second downward recess of the second coupling profile, and if applied, at least one second locking element is facing, and preferably co-acting with, at least one third locking element to realise a vertical locking effect.

2. Multi-purpose tile system, in particular a floor tile system, preferably according to clause 1, comprising a plurality of multi-purpose tiles, in particular floor tiles, wherein at least one first tile comprises at least one first edge having a first coupling profile comprising:

a sideward tongue extending in a direction substantially parallel to the upper side of the tile, at least one first downward flank lying at a distance from the sideward tongue, and a first downward recess formed between the sideward tongue and the first downward flank, wherein at least one second tile comprises at least one second edge having a second coupling profile comprising:

a downward tongue extending in a direction substantially perpendicular to the upper side of the tile, at least one second downward flank lying at a distance from the downward tongue, a second downward recess formed between the downward tongue and the downward flank, and preferably, at least one second locking element, and wherein at least one third tile comprises at least one third edge having a third coupling profile comprising:

a third recess configured for accommodating at least a part of the sideward tongue of the first coupling profile of a further tile, said third recess being defined by an upper lip and a lower lip, wherein said lower lip is provided with an upward locking element, and preferably, at least one third locking element, and wherein the first coupling profile and the third coupling profile are configured such that two of such tiles can be coupled to each other at the first and third edges by means of a turning movement, wherein, in coupled condition:

at least a part of the sideward tongue of the first coupling profile of a tile is inserted into the third recess of the third coupling profile of an adjacent tile, and at least a part of the upward locking element of the third coupling profile is inserted into the first downward recess of the first coupling profile, and wherein the second coupling profile and the third coupling profile are configured such that the two of such tiles can be coupled to each other at the second and third edges by means of a fold-down movement and/or a vertical movement, wherein, in coupled condition:

at least a part of the downward tongue of the second coupling profile is inserted in the third recess of the third coupling profile, and at least a part of the upward locking element of the third coupling profile is inserted in the second downward recess of the second coupling profile, if applied, at least one second locking element is facing, and preferably co-acting with, at least one third locking element to realise a vertical effect, and wherein the first tile and/or the second tile and/or the third tile may be formed by the same tile.

3. Tile system according to one of the foregoing clauses, wherein each tile comprises a first pair of opposing edges consisting of the first edge and the third edge.

4. Tile system according to one of the foregoing clauses, wherein each tile comprises a first pair of opposing edges consisting of the second edge and the third edge.

5. Tile system according to one of the foregoing clauses, wherein the first coupling profile and the third coupling profile are configured for locking together tiles both vertically and horizontally.

6. Tile system according to one of the foregoing clauses, wherein the second coupling profile and the third coupling profile are configured for locking together tiles both vertically and horizontally.

7. Tile system according to one of the foregoing clauses, wherein at least one second locking element of the second coupling profile is provided at the second downward flank of the second coupling profile, and wherein at least one third locking element of the third coupling profile is provided at a distal side of the lower lip facing away from the third recess and/or a distal side of the upward locking element facing away from the third recess.

8. Tile system according to one of the foregoing clauses, wherein at least one second locking element of the second coupling profile is provided at a distal side of the downward tongue facing away from the second downward recess, and wherein at least one third locking element of the third coupling profile is provided at a side of the upper lip, in coupled condition facing said distal side of the downward tongue of the second coupling profile of an adjacent tile.

9. Tile system according to clause 8, wherein the co-action between the second locking element and the third locking element for creating a vertical locking effect in coupled condition of two tiles, defines a tangent T1 which encloses an angle A1 with a plane defined by the tile, which angle A1 is smaller than an angle A2 enclosed by said plane defined by the tile and a tangent T2 defined by a co-action between an inclined part of a proximal side of the upward locking element facing toward the third recess and an inclined part of a proximal side of the downward tongue facing toward the second downward flank, wherein, preferably, the greatest difference between angle A1 and angle A2 is situated between 5 and 20 degrees.

10. Tile system according to clause 8 or 9, wherein said second locking element and said third locking element are positioned closer to the upper side of the tile compared to an upper side of the upward locking element.

11. Tile system according to one of the foregoing clauses, wherein the first coupling profile comprises at least one first locking element configured to face, and preferably co-act with, the third locking element of the third coupling profile of an adjacent tile in coupled condition.

12. Tile system according to clause 11, wherein at least one first locking element of the first coupling profile is provided at the first downward flank of the first coupling profile, and wherein at least one third locking element of the third coupling profile is provided at a distal side of the lower lip facing away from the third recess and/or a distal side of the upward locking element facing away from the third recess.

13. Tile system according to clause 11 or 12, wherein at least one first locking element of the first coupling profile is provided at a distal side of the first coupling profile, being located above at least a part of the sideward tongue, and wherein at least one the third locking element of the third coupling profile is provided at a side of the upper lip, in coupled condition facing said distal side of the first coupling profile of an adjacent tile.

14. Tile system according to one of the foregoing clauses, wherein at least a part of the proximal side of the upward locking element of the third coupling profile, facing the third recess, is upwardly inclined in a direction away from the upper lip, preferably in such a way that an angle is enclosed with the normal perpendicular to the plane defined by each tile wherein said angle is situated between 0 and 60 degrees, in particular between 0 and 45 degrees.

15. Tile system according to one of the foregoing clauses, wherein at least a part of the proximal side of the downward tongue of the second coupling profile, facing the second downward recess, is downwardly inclined in a direction away from the second downward flank, preferably in such a way that an angle is enclosed with the normal perpendicular to the plane defined by each tile wherein said angle is situated between 0 and 60 degrees, in particular between 0 and 45 degrees.

16. Tile system according to one of the foregoing clauses, wherein at least a part of the proximal side of the sideward tongue of the first coupling profile, facing the first downward recess, is downwardly inclined in a direction away from the first downward flank, preferably in such a way that an angle is enclosed with the normal perpendicular to the plane defined by each tile wherein said angle is situated between 0 and 60 degrees, in particular between 0 and 45 degrees.

17. Tile system according to one of the foregoing clauses, wherein at least a part of the proximal side of the upward locking element of the third coupling profile, facing the third recess, is upwardly inclined in a direction towards the upper lip, preferably in such a way that an angle is enclosed with the normal perpendicular to the plane defined by each tile wherein said angle is situated between 0 and 60 degrees, in particular between 0 and 45 degrees.

18. Tile system according to one of the foregoing clauses, wherein at least a part of the proximal side of the downward tongue of the second coupling profile, facing the second downward recess, is downwardly inclined in a direction towards the second downward flank, preferably in such a way that an angle is enclosed with the normal perpendicular to the plane defined by each tile wherein said angle is situated between 0 and 60 degrees, in particular between 0 and 45 degrees.

19. Tile system according to one of the foregoing clauses, wherein at least a part of the proximal side of the sideward tongue of the first coupling profile, facing the first downward recess, is downwardly inclined in a direction towards the first downward flank, preferably in such a way that an angle is enclosed with the normal perpendicular to the plane defined by each tile wherein said angle is situated between 0 and 60 degrees, in particular between 0 and 45 degrees.

20. Tile system according to one of the foregoing clauses, wherein a first transition zone between the proximal side of the sideward tongue of the first coupling profile and a lower side of the sideward tongue of the first coupling profile is curved.

21. Tile system according to one of the foregoing clauses, wherein a second transition zone between the proximal side of the downward tongue of the second coupling profile and a lower side of the downward tongue of the second coupling profile is curved.

22. Tile system according to one of the foregoing clauses, wherein a third transition zone between the proximal side of the upward locking element of the third coupling profile and an upper side of the upward locking element of the third coupling profile is curved.

23. Tile system according to one of the foregoing clauses, wherein at the lower side of the lower lip of the third coupling profile, a recess is present, which extends up to the distal end of the lower lip and which allows a bending of the lower lip in downward direction.

24. Tile system according to one of the foregoing clauses, wherein the first coupling profile and the third coupling profile are configured such that in coupled condition a so-called pretension is existing, which forces the respective tiles at the respective first edge and third edge towards each other, wherein this preferably is performed by applying overlapping contours.

25. Tile system according to one of the foregoing clauses, wherein the second coupling profile and the third coupling profile are configured such that in coupled condition a so-called pretension is existing, which forces the respective tiles at the respective second edge and third edge towards each other, wherein this preferably is performed by applying overlapping contours.

26. Tile system according to clause 24 or 25, wherein the pretension is the result of a deformation, either an elastic bending or an elastic compression, or a combination of both.

27. Tile system according to one of the foregoing clauses, wherein the first coupling profile and the third coupling profile are configured such that a coupled condition is substantially free of pretension between the first coupling profile and the third coupling profile.

28. Tile system according to one of the foregoing clauses, wherein the second coupling profile and the third coupling profile are configured such that a coupled condition is substantially free of pretension between the second coupling profile and the third coupling profile.

29. Tile system according to one of the foregoing clauses, wherein the first coupling profile and the third coupling profile are configured such that in coupled condition a plurality of, preferably at least three, distant contact zones are present, wherein in between each pair of adjacent contact zones a space remains.

30. Tile system according to one of the foregoing clauses, wherein the second coupling profile and the third coupling profile are configured such that in coupled condition a plurality of, preferably at least three, distant contact zones are present, wherein in between each pair of adjacent contact zones a space remains.

31. Tile system according to one of the foregoing clauses, wherein the first edge and the third edge, in coupled condition, define a first closing surface defined as a first vertical plane through the upper edges of the coupled tiles or at least the location where the tiles come together at the upper side of the tiles.

32. Tile system according to clause 31, wherein the first coupling profile and the third coupling profile are configured such that in coupled condition, each of the sideward tongue and the third recess extends through said first vertical plane.

33. Tile system according to one of the foregoing clauses, wherein the second edge and the third edge, in coupled condition, define a second closing surface defining a second vertical plane through the upper edges of the coupled tiles or at least the location where the tiles come together at the upper side of the tiles.

34. Tile system according to clause 33, wherein the second coupling profile and the third coupling profile are configured such that in coupled condition, the downward tongue is positioned at one side of the second vertical plane, and the third recess extends through said second vertical plane.

35. Tile system according to one of the foregoing clauses, wherein a distal side of the downward tongue, facing away from the second downward recess, comprises at least a vertical upper wall part adjacent to the upper side of the tile, and, adjacent to and located below said vertical wall part, an angled wall part that angles inward toward a chamfered and/or curved lower wall part of said distal side of the downward tongue, wherein, optionally, in between said angled wall part and said lower wall part an intermediate vertical wall part is situated.

36. Tile system according to clause 35, wherein a second locking element, configured to co-act with a third locking element of another tile, is provided at the upper wall part of the distal side of the downward tongue.

37. Tile system according to one of the foregoing clauses, wherein a lower side of the sideward tongue of the first coupling profile, in coupled condition of two tiles, is supported by a lower surface of the third recess of the third coupling profile, which, preferably, causes a fixation in the mutual position of the first coupling profile and the third coupling profile, wherein the second coupling profile and third coupling profile preferable cooperate under tension.

38. Tile system according to one of the foregoing clauses, wherein a lower side of the downward tongue of the second coupling profile, in coupled condition of two tiles, is supported by a lower surface of the third recess of the third coupling profile, which, preferably, causes a fixation in the mutual position of the second coupling profile and the third coupling profile, wherein the coupling second profile and coupling third profile preferable cooperate under tension.

39. Tile system according to one of the foregoing clauses, wherein in a coupled condition of tiles, the first downward flank of the first coupling profile and a distal side of the upward locking element and/or lower lip of the third coupling profile, facing the first downward flank, are positioned at a distance from each other.

40. Tile system according to one of the foregoing clauses, wherein in a coupled condition of tiles, the second downward flank of the second coupling profile and a distal side of the upward locking element and/or lower lip of the third coupling profile, facing the second downward flank, are positioned at a distance from each other.

41. Tile system according to one of the foregoing clauses, wherein at least a part of, and preferably the complete, upper side of the upward locking element is inclined downwardly in a direction facing way from the upper lip of the third coupling profile.

42. Tile system according to one of the foregoing clauses, wherein at least a part of, and preferably the complete, upper side of the first downward recess is inclined downwardly towards the first downward flank.

43. Tile system according to clause 41 and 42, wherein both inclinations mutually enclose an angle between 0 and 5 degrees.

44. Tile system according to one of the foregoing clauses, wherein at least a part of, and preferably the complete, upper side of the second downward recess is inclined downwardly towards the second downward flank.

45. Tile system according to clause 41 and 44, wherein both inclinations mutually enclose an angle between 0 and 5 degrees.

46. Tile system according to one of the foregoing clauses, wherein, in coupled condition of two tiles, the upper side of the upward locking element of the third coupling profile is positioned at a distance from the upper side of the first downward recess of the first coupling profile.

47. Tile system according to one of the foregoing clauses, wherein, in coupled condition of two tiles, the upper side of the upward locking element of the third coupling profile is positioned at a distance from the upper side of the second downward recess of the second coupling profile.

48. Tile system according to one of the foregoing clauses, wherein the difference between the upper lip and the lower lip, measured in the plane of the tile is larger than 1.0 times, and is preferably at least 1.25 times, the thickness of the tile.

49. Tile system according to one of the foregoing clauses, wherein each tile comprises at least two third coupling profiles.

50. Tile system according to one of the foregoing clauses, wherein an upper side of the upward locking element is positioned at a lower level than the upper lip of the third coupling profile.

51. Tile system according to any of the foregoing clauses, wherein the third locking element comprises at least one outward bulge, and that the first locking element comprises at least one first locking groove, which outward bulge is adapted to be at least partially received in the first locking groove of an adjacent coupled tile for the purpose of realizing a locked coupling, preferably a vertically locked coupling.

52. Tile system according to any of the foregoing clauses, wherein the third locking element comprises at least one outward bulge, and that the second locking element comprises at least one second locking groove, which outward bulge is adapted to be at least partially received in the second locking groove of an adjacent coupled tile for the purpose of realizing a locked coupling, preferably a vertically locked coupling.

53. Tile system according to any of the foregoing clauses, wherein the third locking element is positioned at a distal side of the lower lip and/or the upward locking element, and at a distance both from a lower side of the lower lip and an upper side of the upward locking element.

54. Tile system according to one of the foregoing clauses, wherein each coupling profile is free from hook and loop fasteners and/or adhesive connections.

55. Tile system according to one of the foregoing clauses, wherein each coupling profile is provided with chamfers, such as bevels, at or near the upper side of the tiles.

56. Tile system according to one of the foregoing, wherein the system comprises two different types of tiles (A and B respectively), and wherein the coupling profiles of one type of tile along are arranged in a mirror-inverted manner relative to the corresponding coupling profiles of the other type of tile wherein preferably at least one tile (A) has a configuration, wherein the edges are arranged, as seen from a top view in a clockwise direction, in the order: a first edge, a third edge, another third edge, and a second edge, and wherein preferably at least one tile (B) has a configuration, wherein the edges are arranged, as seen from a top view in a clockwise direction, in the order: a first edge, a second edge, a third edge, and another third edge.

57. Tile system according to one of the foregoing clauses, wherein the length of opposing edges of a tile is substantially identical.

58. Tile system according to one of the foregoing clauses, wherein each tile is free of any other coupling profile than at least one first coupling profile, at least one second coupling profile, and at least one, preferably at least two, third coupling profiles.

59. Tile system according to one of the foregoing clauses, wherein a plurality of tiles have a square and/or rectangular shape.

60. Tile system according to one of the foregoing clauses, wherein a plurality of tiles have a parallelogramical shape, wherein said tiles are configured to being joined in a chevron pattern, wherein two pairs of adjacent edges enclose an acute angle, and wherein two pairs of other adjacent edges enclose a obtuse angle.

61. Tile system according to clause 60, wherein the acute angle is situated between 30 and 60 degrees, and is preferably substantially 45 degrees.

62. Tile system according to clause 61, wherein the obtuse angle is situated between 120 and 150 degrees, and is preferably substantially 135 degrees.

63. Tile system according to one of the foregoing clauses, wherein at least one tile comprises at least one upper substrate affixed to an upper side of a base layer, wherein said upper substrate preferably comprises a decorative layer, preferably a decorative print layer.

64. Tile system according to clause 63, wherein the at least one upper substrate comprises:

a decorative layer and an abrasion resistant wear layer covering said decorative layer, wherein a top surface of said wear layer is the top surface of said tile, and wherein the wear layer is a transparent material, such that decorative layer is visible through the transparent wear layer, and, optionally, a transparent finishing layer situated in between the decorative layer and the wear layer.

65. Tile system according to one of clauses 63-64, wherein the upper substrate is at least partially made of at least one material selected from the group consisting of: metals, alloys, natural stone, marble, granite, slate, glass, ceramics, macromolecular materials such as vinyl monomer copolymers and/or homopolymers; condensation polymers such as polyesters, polyamides, polyimides, epoxy resins, phenol-formaldehyde resins, urea formaldehyde resins; natural macromolecular materials or modified derivatives thereof such as plant fibres, animal fibres, mineral fibres, ceramic fibres and carbon fibres.

66. Tile system according to in clause 65, wherein the vinyl monomer copolymers and/or homo-polymers are selected from the group consisting of polyethylene, polyvinyl chloride, polystyrene, polymethacrylates, polyacrylates, polyacrylamides, ABS, (acrylonitrile-butadiene-styrene) copolymers, polypropylene, ethylene-propylene copolymers, polyvinylidene chloride, polytetrafluoroethylene, polyvinylidene fluoride, hexafluoropropene, and styrene-maleic anhydride copolymers.

67. Tile system according to one of clauses 63-66, wherein the at least one upper substrate is affixed to the upper side of the base layer by means of an adhesive.

68. Tile system according to one of clauses 63-67, wherein at least one tile comprises a plurality of strip shaped upper substrates affixed to an upper side the base layer, wherein said upper substrates are arranged side by side in the same plane, preferably in a parallel configuration.

69. Tile system according to clause 68, wherein the plurality of upper substrates substantially completely cover the upper surface of the base layer.

70. Tile system according to clause 68 or 69, wherein each of the plurality of upper substrates extends from the first edge to the second edge of the tile.

71. Tile system according to one of clauses 68-70, wherein each of the plurality of upper substrates comprises a decorative layer, wherein the decorative layers of at least two adjacently arranged upper substrates have different appearances.

72. Tile system according to one of the foregoing clauses, wherein each tile comprises at least one base layer.

73. Tile system according to clause 72, wherein at least a part of the base layer is foamed.

74. Tile system according to clause 73, the foamed base layer is at least partially made of polyvinylchloride (PVC).

75. Tile system according to one clauses 72-74, wherein the base layer comprises at least one polymer selected from the group consisting of: ethylene vinyl acetate (EVA), polyurethane (PU), polyethylene (PE), polypropylene (PP), polystyrene (PS), polyvinylchloride (PVC), polyethylene terephthalate (PET), Polyisocyanurate (PIR), or mixtures thereof.

76. Tile system according to one of clauses 72-75, wherein the base layer comprises at least one wood-based material.

77. Tile system according to one of clauses 72-76, wherein the base layer comprises at least one composite material of at least one polymeric material and at least one non-polymeric material.

78. Tile system according to clause 77, wherein at least one non-polymeric material is selected from the group consisting of: talc, chalk, wood, calcium carbonate, and a mineral filler.

79. Tile system according to clause 77 or 78, wherein at least one non-polymeric material is selected from the group consisting of: a salt, a stearate salt, calcium stearate, and zinc stearate.

80. Tile system according to one of clauses 72-79, wherein the base layer comprises at least one impact modifier comprising at least one alkyl methacrylates, wherein said alkyl methacrylate is preferably chosen from the group consisting of: methyl methacrylate, ethyl methacrylate, propyl methacrylate, isopropyl methacrylate, t-butyl methacrylate and isobutyl methacrylate.

81. Tile system according to any of clauses 72-80, wherein the base layer has a density in the range of about 0.1 to 1.5 g/cm3.

82. Tile system according to any of clauses 72-81, wherein the foamed composite contains approximately 3% to 9% by weight of the toughening agent.

83. Tile system according to any of clauses 72-82, wherein the base layer has an elastic modulus of more than 700 MPa.

84. Tile system according to any of clauses 72-83, wherein the density of the base layer varies along the height of the base layer.

85. Tile system according to clause 84, wherein a top section and/or a bottom section of the base layer forms a crust layer having a porosity which is less than the porosity of a centre region of the base layer, wherein the thickness of each crust layer is between 0.01 and 1 mm, preferably between 0.1 and 0.8 mm.

86. Tile system according to one of clauses 72-85, wherein the base layer is free of plasticizer.

87. Tile system according to one clauses 72-86, wherein each tile comprises at least one backing layer affixed to a bottom side of the base layer, wherein said at least one backing layer at least partially made of a flexible material, preferably an elastomer or cork.

88. Tile system according to clause 87, wherein the thickness of the backing layer is at least 0.5 mm.

89. Tile system according to one of the foregoing clauses, wherein each tile comprises at least one reinforcing layer, wherein the density of the reinforcing layer is preferably situated between 1000 and 2000 kg/m3, preferably between 1400- and 1900 kg/m3, and more preferably between 1400-1700 kg/m3.

90. Tile system according to one of clauses 72-88 and clause 89, wherein the base layer is provided with at least one reinforcing layer incorporated in the base layer, wherein the reinforcing layer is preferably a fibre-reinforced layer, such as a glass fibre mat.

91. Tile system according to one of the foregoing clauses, wherein at least a part of the first coupling profile and/or at least a part of second coupling profile and/or at least a part of the third coupling profile of each tile is integrally connected to the base layer.

92. Tile system according to one of the foregoing clauses, wherein the first coupling profile and/or the second coupling profile and/or the third coupling profile allows deformation during coupling and uncoupling of tiles.

93. Tile system according to any of the foregoing clauses, wherein at least a number of tiles is identical.

94. Tile system according to any of the foregoing clauses, wherein at least a number of tiles have different sizes and/or different shapes.

95. Tile system according to any of the foregoing clauses, wherein the tile system comprises different types of tiles (A and B respectively), wherein the size of a first type of tile (A) differs from the size of second type of tile (B).

96. Tile system according to clause 94 or 95, wherein distinctive visual markings are applied to different tile types, preferably for installation purposes.

97. Tile system according to clause 96, wherein distinctive visual markings are applied to the upper side of the upward locking element of the third coupling profile of each tile type.

98. Tile covering, in particular floor covering, ceiling covering, or wall covering, consisting of mutually coupled tiles of the tile system according to any of the clauses 1-97.

99. Tile for use in multi-purpose tile system according to one of clauses 1-97.

100. Method for installing a tile system, in particular a floor tile system, according to one of clauses 1-97, comprising the steps of:

a) positioning at least one first tile on a supporting surface, in particular a subfloor, b) providing at least one second tile to be coupled to said at least one first tile, c) selecting at least one coupling profile from the group consisting of (i) the first coupling profile of the second tile, and (ii) the second coupling profile of the second tile, to be coupled to at least one third coupling profile of at least one first tile; and/or selecting at least one coupling profile from the group consisting of (i) the first coupling profile of the first tile, and (ii) the second coupling profile of the first tile, to be coupled to at least one third coupling profile of at least one second tile; and d) coupling the at least one selected coupling profile of a said second tile or first tile, to the at least one third coupling profile of a first tile or second tile.

101. Method according to clause 100, wherein the first coupling profile and the third coupling profile are configured such that two of such tiles can be coupled to each other by means of a turning movement, and wherein the second coupling profile and the third coupling profile are configured such that the two of such tiles can be coupled to each other by means of a fold-down movement and/or a vertical movement.

BRIEF DESCRIPTION OF THE DRAWINGS

The invention will be elucidated on the basis of non-limitative exemplary embodiments shown in the following figures, wherein.

DESCRIPTION OF THE INVENTION

Figure 1A:
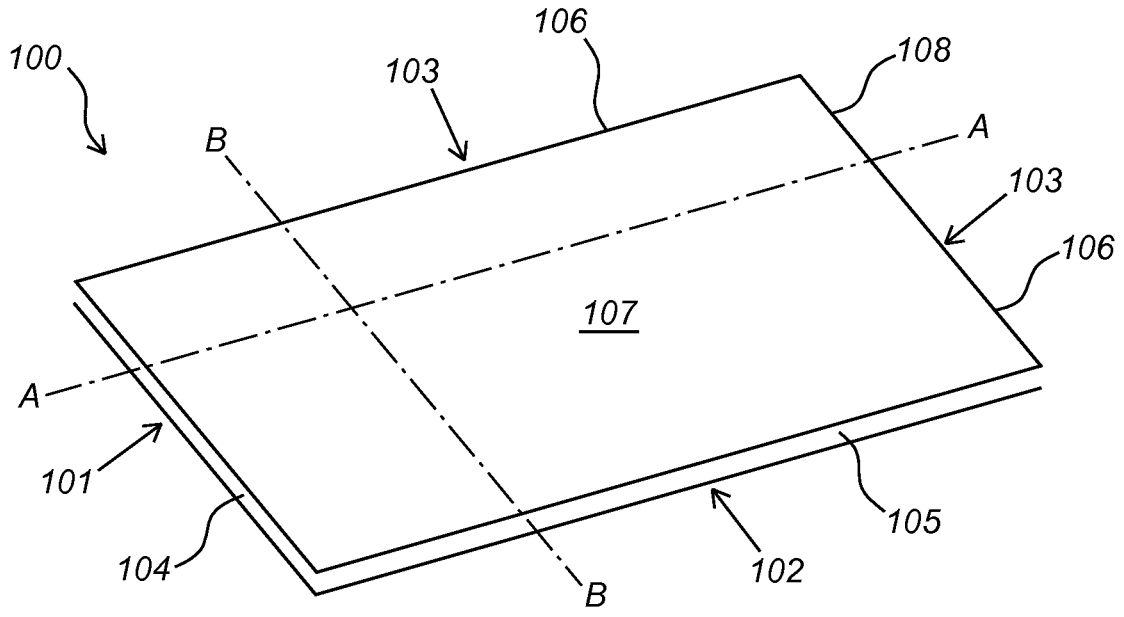
FIG. 1*a* shows a schematic representation of a multi-purpose tile for use in a multi-purpose tile system according to the invention.

FIG. 1*a* shows a schematic representation of a multi-purpose tile (100) for use in a multi-purpose tile system (110) according to the invention. The figure shows a tile (100) comprising a first pair of opposing edges consisting of a first edge (101) and an opposite third edge (103) and a second pair of opposing edges consisting of a second edge (102) and an opposing third edge (103). The first, second and third edges (101, 102, 103) are respectively provided with first, second and third coupling profiles (104, 105, 106). The first coupling profile (104) and the third coupling profile (106) are configured such that two of such tiles (100) can be coupled to each other at the first and third edges (101, 103) by means of a turning movement. Moreover, the second coupling profile (105) and the third coupling profile (106) are configured such that the two of such tiles (100) can be coupled to each other at the second and third edges (102, 103) by means of a fold-down movement and/or a vertical movement. The proportional relationship between the width and the length of the tile (100) may be chosen at will. Figure 1*a* shows only one of the many possibilities wherein the tile has a upper side (107) with a rectangular contour (108). It is however also possible that the width and the length of the tile (100) are the same such that the tile (100) has an upper side (107) with a square contour.

Figure 1B:
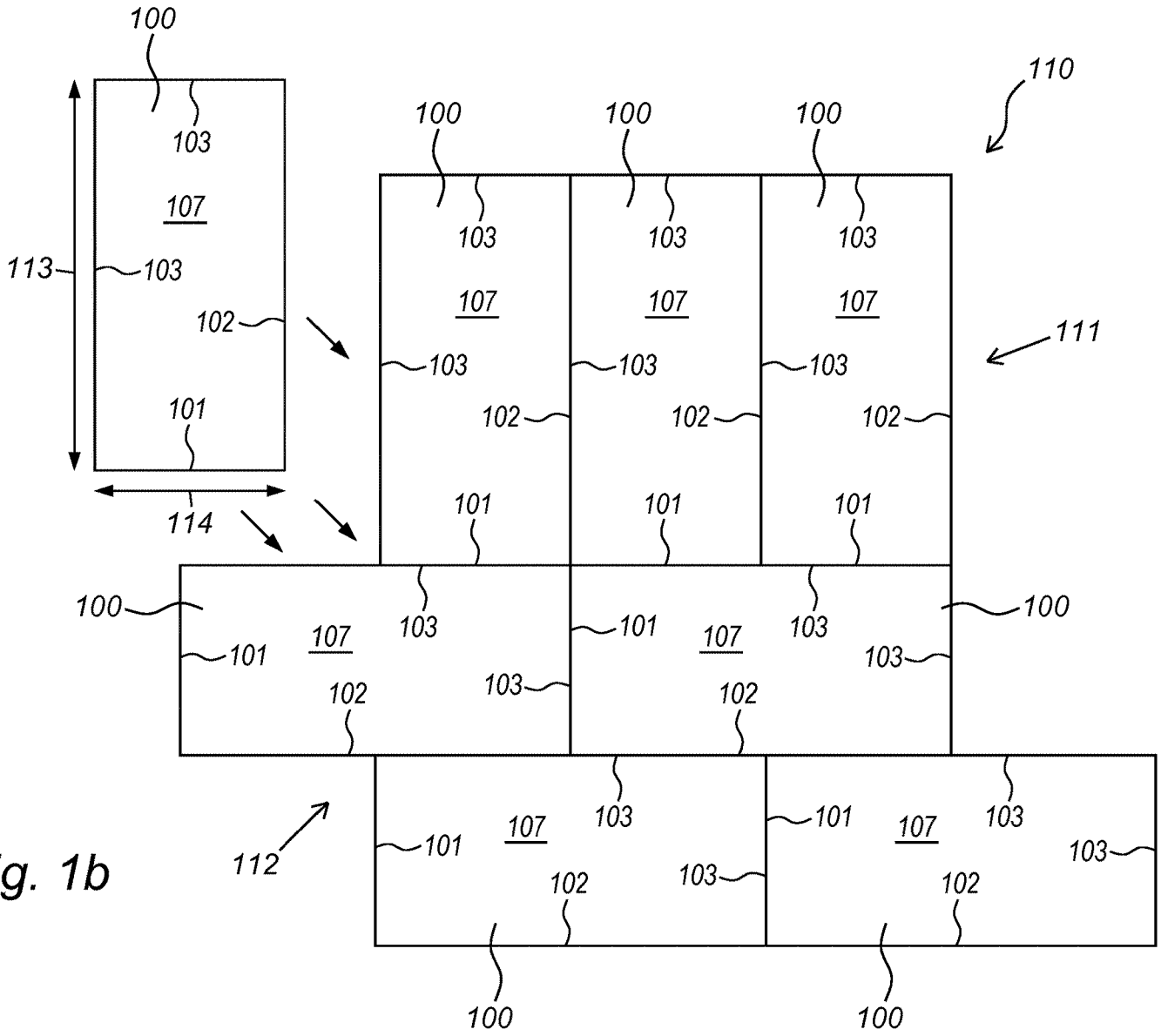
FIG. 1*b* shows a schematic representation of a multi-purpose tile system comprising a plurality of multi-purpose tiles as shown in FIG. 1*a;*

FIG. 1*b* shows a schematic representation of a multi-purpose tile system (110) comprising a plurality of multi-purpose tiles (100) as shown in FIG. 1*a*. Although each of the tiles (100) are equivalent, having a first pair of opposing edges consisting of a first edge (101) and an opposite third edge (103) and a second pair of opposing edges consisting of a second edge (102) and an opposing third edge (103), the tiles (100) may, due to the compatibility of the coupling profile of the third edge (103) with the coupling profile of both the first and the second edge (101, 102), be joined in different ways, resulting in differential tile patterns (111, 112) within one multi-purpose tile system (110). In the depicted multi-purpose tile system (110) wherein the individual tiles (110) have an upper side (107) with a rectangular contour (108), the tiles (100) each have a long side (113) and a short side (114). The different tile patterns (111, 112) are hereby created by coupling a first tile pattern (111) of interconnected tiles (100), having their long side (113) connected to the long side (113) of an adjacent tile (100), to a second tile pattern (112) of interconnected tiles (100), having their long side (113) connected to the long side (113) of an adjacent tile (100) and their short side (114) connected to the short side (114) of another adjacent tile (100). The first and second tile patterns (111, 112) are hereby rotated to each other such that the long sides (113) of the tiles (100) of the first tile pattern (111) lie at a 90 degree angle relative to the long sides (113) of the tiles (100) of the second tile pattern (112). This coupling between the different tile patterns (111, 112) is made possible through the connection of the short sides (114) of the tiles (100) of the first tile pattern (111) to the long sides (113) of the tiles (100) of the second tile pattern (112). Installation of the tile system (110) can be realized by angling down the first edge (101) of a tile (100) to be installed with respect to a third edge (103) of an already installed tile (100), which will commonly mutually lock said tiles (100) in both vertical and horizontal direction. During this angling or turning movement of the tile (100) to be installed with respect to the already installed tile (100), the second edge (102) of the tile (100) to be installed will be connected (simultaneously) to the third edge (103) of another already installed tile (100), which is typically realized by lowering or folding down the tile (100) to be installed with respect to the other already installed tile (100) during which the second edge (102) of the tile (100) to be installed and the third edge (103) of the other already installed tile (100) will be scissored (zipped) into each other. This results in a locking of the tile (100) to be installed with respect to the other already installed tile (100) both in horizontal and vertical direction.

Figure 2A:
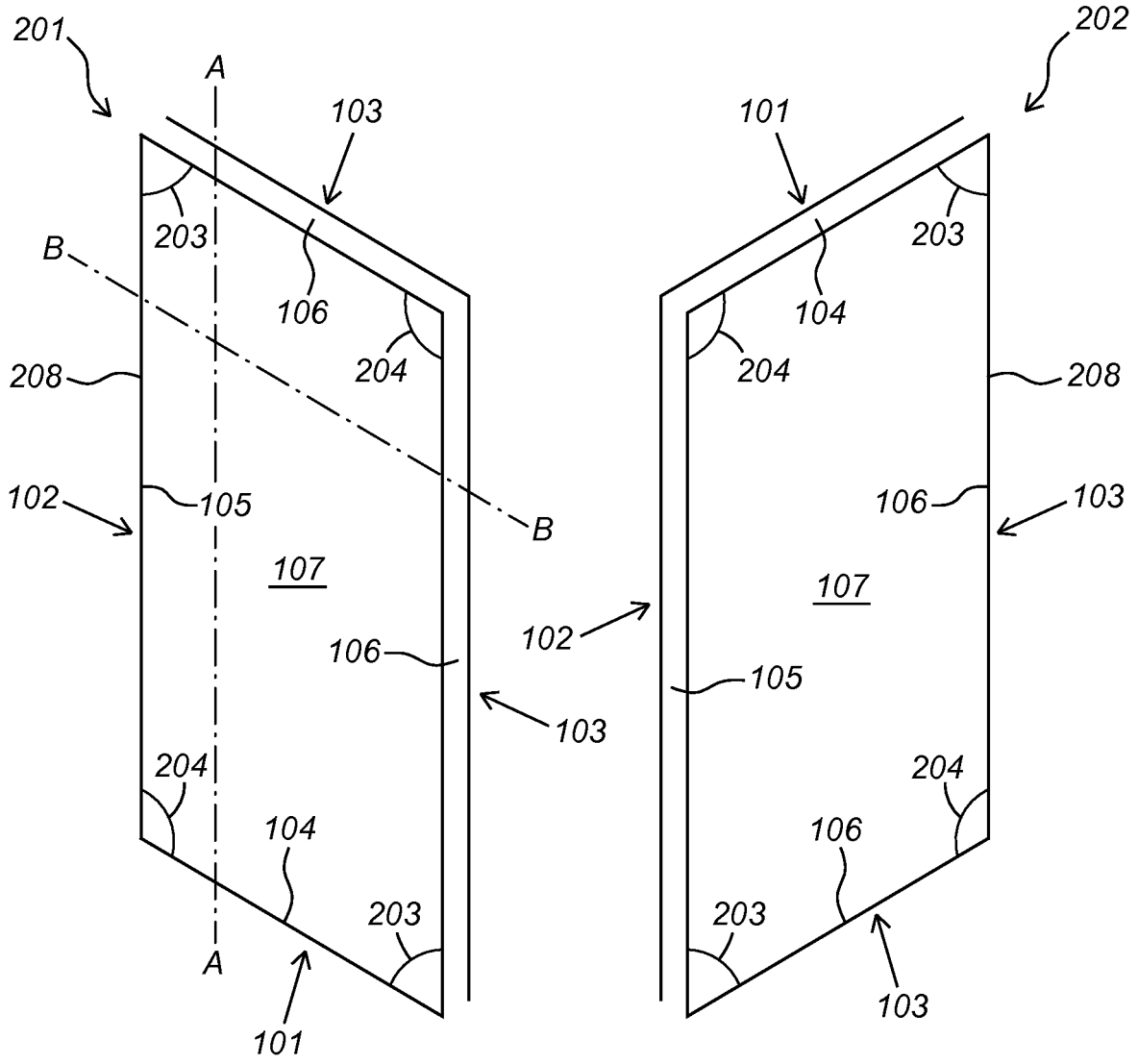
FIG. 2*a* shows a schematic representation of two different types of multi-purpose tiles for use in another embodiment of a multi-purpose tile system according to the invention.

FIG. 2*a* shows a schematic representation of two different types of multi-purpose tiles (201, 202) for use in another embodiment of a multi-purpose tile system (200) according to the invention. Just as the multi-purpose tile (100) shown in FIG. 1*a*, each of these tiles (201, 202) comprises a first pair of opposing edges consisting of a first edge (101) and an opposite third edge (103) and a second pair of opposing edges consisting of a second edge (102) and an opposing third edge (103). Again, the first, second and third edges (101, 102, 103) are respectively provided with first, second and third coupling profiles (104, 105, 106), wherein the first coupling profile (104) and the third coupling profile (106) are configured such that two tiles (201, 202) can be coupled to each other at the first and third edges (101, 103) by means of a turning movement, and the second coupling profile (105) and the third coupling profile (106) are configured such that the two tiles (201, 202) can be coupled to each other at the second and third edges (102, 103) by means of a fold-down movement and/or a vertical movement. This time however, there are two different types of tiles (201, 202), wherein the coupling profiles (105, 106) of one pair of opposing edges (102, 103) on the first type of tile (201) are arranged in a mirror-inverted manner relative to the coupling profiles (105, 106) of the corresponding pair of opposing edges (102, 103) on the second type of tile (202). Note that the depicted edge pairs of the different types of tiles (201, 202) that are mirror-inverted are formed by second and third edges (102, 103). However it is likewise possible that the mirror-inverted edge pairs are formed by first and third edges (101, 103). Moreover, the multi-purpose tiles (201, 202) for use in this multi-purpose tile system (200) have an upper side (107) with a parallelogram-shaped contour (208). Two adjoining edges (101, 102, 103) of these tiles (201, 202) hereto either enclose an acute angle (203) or a obtuse angle (204). In this specific embodiment, the first and second edge (101, 102) respectively the third edges (103) enclose an obtuse angle (204) of the same size, while the first and the third edge (101, 103) respectively the second and third edge (102, 103) enclose an acute angle (203) of the same size. The difference in tile configuration and parallelogram-shaped contour (208) of their upper side (107) allows these tiles (201, 202) to form a chevron pattern (205) in a joined state.

Figure 2B:
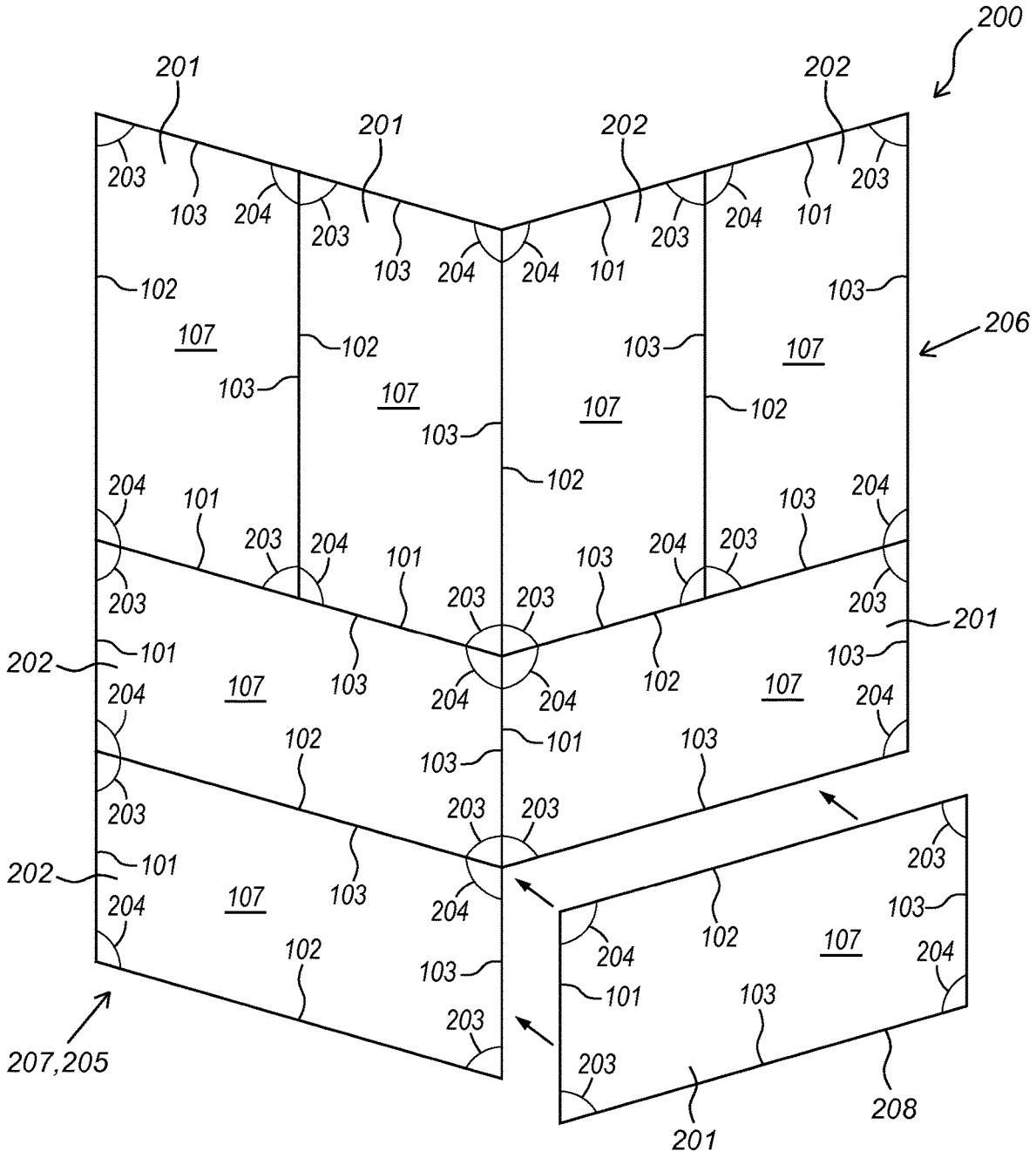
FIG. 2*b* shows a schematic representation of a multi-purpose tile system comprising a plurality of multi-purpose tiles as shown in FIG. 2*a;*

FIG. 2*b* shows a schematic representation of a multi-purpose tile system (200) comprising a plurality of multi-purpose tiles (201, 202) as shown in FIG. 2*a*. As already discussed previously, the multi-purpose tiles (201, 202) forming part of this multi-purpose tile system (200) come in two different (mirrored) types/configurations. While the difference in tile configuration and parallelogram-shape of their top surface (107) allows these tiles (201, 202) to form a chevron pattern (205) in a joined state, having a first pair of opposing edges consisting of a first edge (101) and an opposite third edge (103) and a second pair of opposing edges consisting of a second edge (102) and an opposing third edge (103), wherein the coupling profile (106) of the third edge (103) is compatible with the coupling profile (104, 105) of both the first and the second edge (101, 102), allows the tiles (201, 202) to be joined in different ways as well, resulting in differential tile patterns (206, 207) within one interconnected multi-purpose tile system (200). Like in the multi-purpose tile system (110) shown in FIG. 1*b*, the different tile patterns (206, 207) are created by coupling a first tile pattern (206) of interconnected tiles (201, 202) to a second tile pattern (207) of interconnected tiles (201, 202). Within these separate tile patterns (206, 207), each tile (201, 202) has each of its pairs of opposing edges (101, 103; 102, 103) connected to the edges (101, 102, 103) of adjacent tiles (201, 202) being part of a corresponding pair of opposing edges (101, 103; 102, 103) of said adjacent tiles (201, 202). The coupling of the first and second tile patterns (206, 207) is however realized through the connection of a tile (201, 202) of first tile pattern (206) with an edge (101, 103) forming part of one pair of opposing edges (101, 103) to a tile (201, 202) of second tile pattern (207) with an edge (102, 103) forming part of the other, non-corresponding pair of opposing edges (102, 103). The result is an interconnected, multi-purpose tile system (200) comprising two different tile patterns (206, 207) that are rotated 90 degrees relative to each other. Installation of the tile system (200) shown in FIG. 2*b* is typically analogous to the installation of the tile system (110) shown in FIG. 1*b*.

Figure 3A:
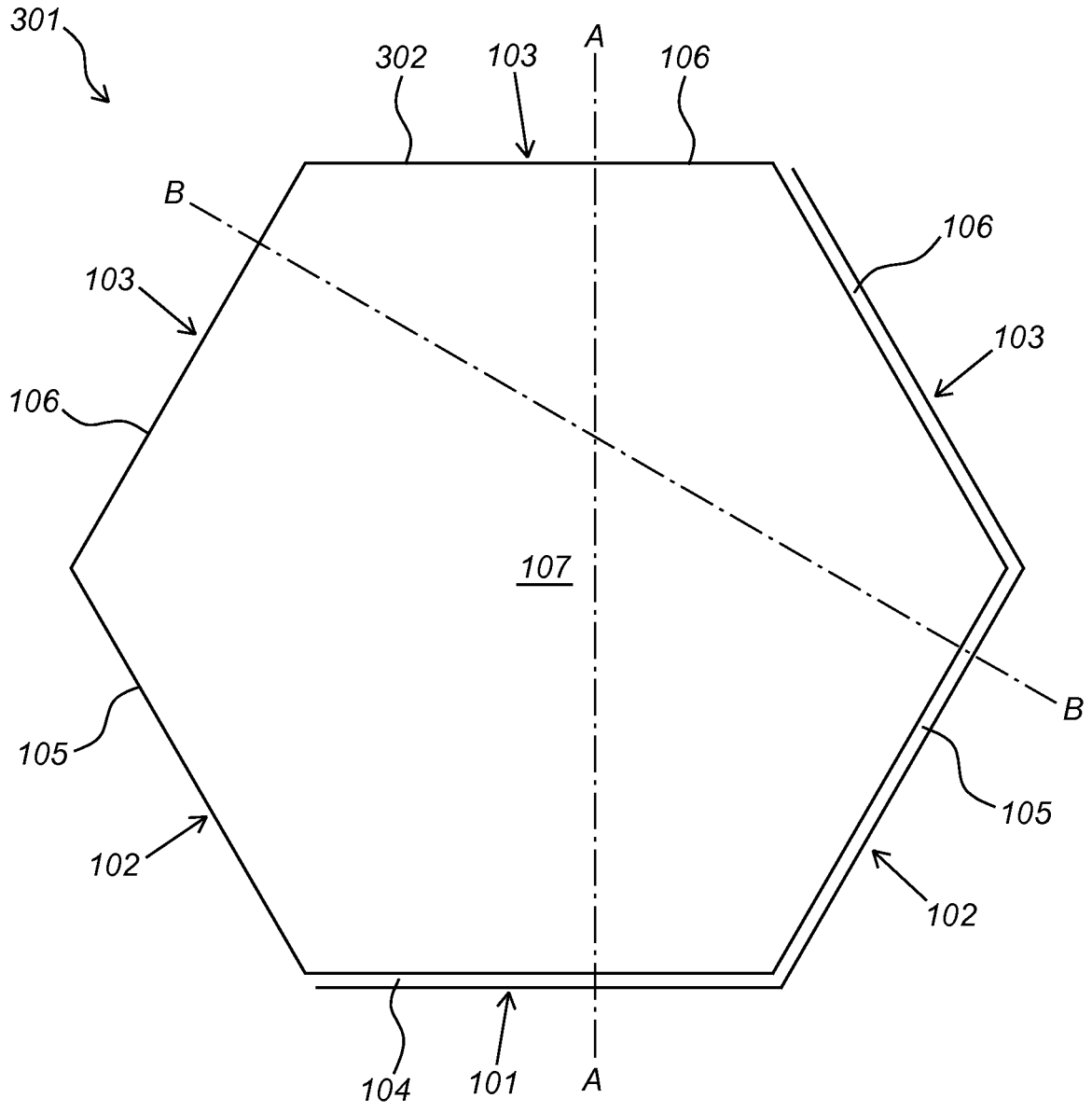
FIG. 3*a* shows a schematic representation of a multi-purpose tile for use in yet another embodiment of a multi-purpose tile system according to the invention.

FIG. 3*a* shows a schematic representation of a multi-purpose tile (301) for use in yet another embodiment of a multi-purpose tile system (300) according to the invention. Other than the multi-purpose tiles (100, 201, 202) shown in FIGS. 1*a* and 2*a*, each of these tiles (301) comprises three pairs of opposing edges and has an upper side (107) with a regular hexagon-shaped contour (302). The first pair of opposing edges consists of a first edge (101) and an opposite third edge (103). The second and third pair of opposing edges consist of a second edge (102) and an opposing third edge (103). The first, second and third edges (101, 102, 103) are hereby positioned such that the third edges (103) lie directly adjacent to each other and the second edges (102) lie on both edges adjacent to the first edge (101). The second edges (102), as a consequence, do not lie adjacent to each other. The commonality between these multi-purpose tiles (301) and the multi-purpose tiles (100, 201, 202) shown in FIGS. 1*a* and 2*a* is however that the first, second and third edges (101, 102, 103) are respectively provided with first, second and third coupling profiles (104, 105, 106), wherein the first coupling profile (104) and the third coupling profile (106) are configured such that two tiles (301) can be coupled to each other at the first and third edges (101, 103) by means of a turning movement, and the second coupling profile (105) and the third coupling profile (106) are configured such that the two tiles (301) can be coupled to each other at the second and third edges (102, 103) by means of a fold-down movement and/or a vertical movement.

Figure 3B:
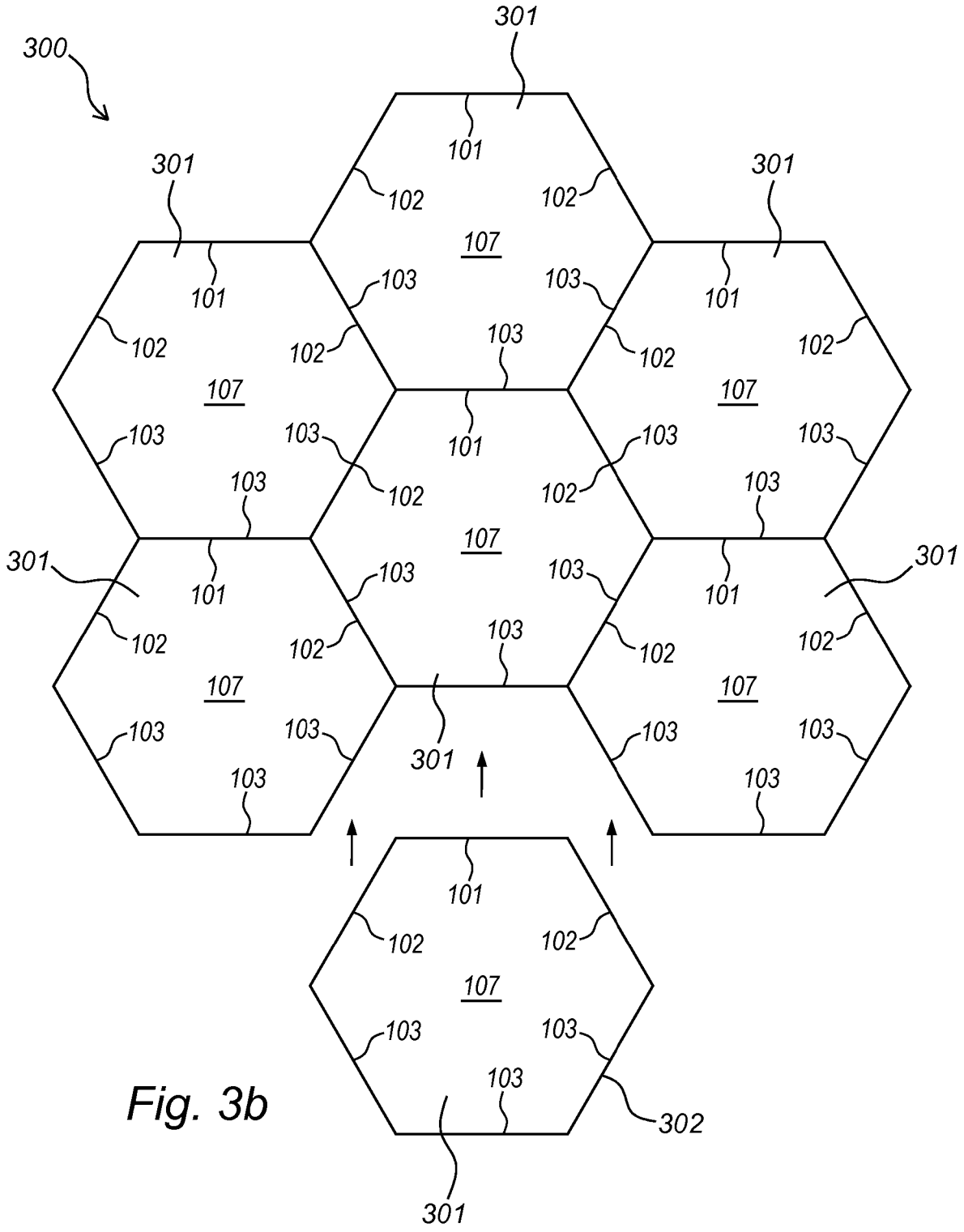
FIG. 3*b* shows a schematic representation of a multi-purpose tile system comprising a plurality of multi-purpose tiles as shown in FIG. 3*a;*

FIG. 3*b* shows a schematic representation of a multi-purpose tile system (300) comprising a plurality of multi-purpose tiles (301) as shown in FIG. 3*a*. In the depicted tile formation, the tiles (301) are all identically oriented. Installation of the tile system (300) can be realized in a similar fashion as the tile systems (110, 200) of FIGS. 1*b* and 2*b*. By angling down the first edge (101) of a tile (301) to be installed with respect to a third edge (103) of an already installed tile (301), said tiles (301) will commonly mutually lock in both vertical and horizontal direction. During this angling or turning movement of the tile (301) to be installed with respect to the already installed tile (301), one or more second edges (102) of the tile (300) to be installed will be connected (simultaneously) to a third edge (103) of one or more other already installed, adjacent tiles (301), which is typically realized by lowering or folding down the tile (301) to be installed with respect to the other already installed tile(s) (301) during which said second edge(s) (102) of the tile (301) to be installed and the third edge(s) (103) of the other already installed tile(s) (301) will be scissored (zipped) into each other. This results in a locking of the tile (301) to be installed with respect to the other already installed tile(s) (301) both in horizontal and vertical direction.

Figure 4A:
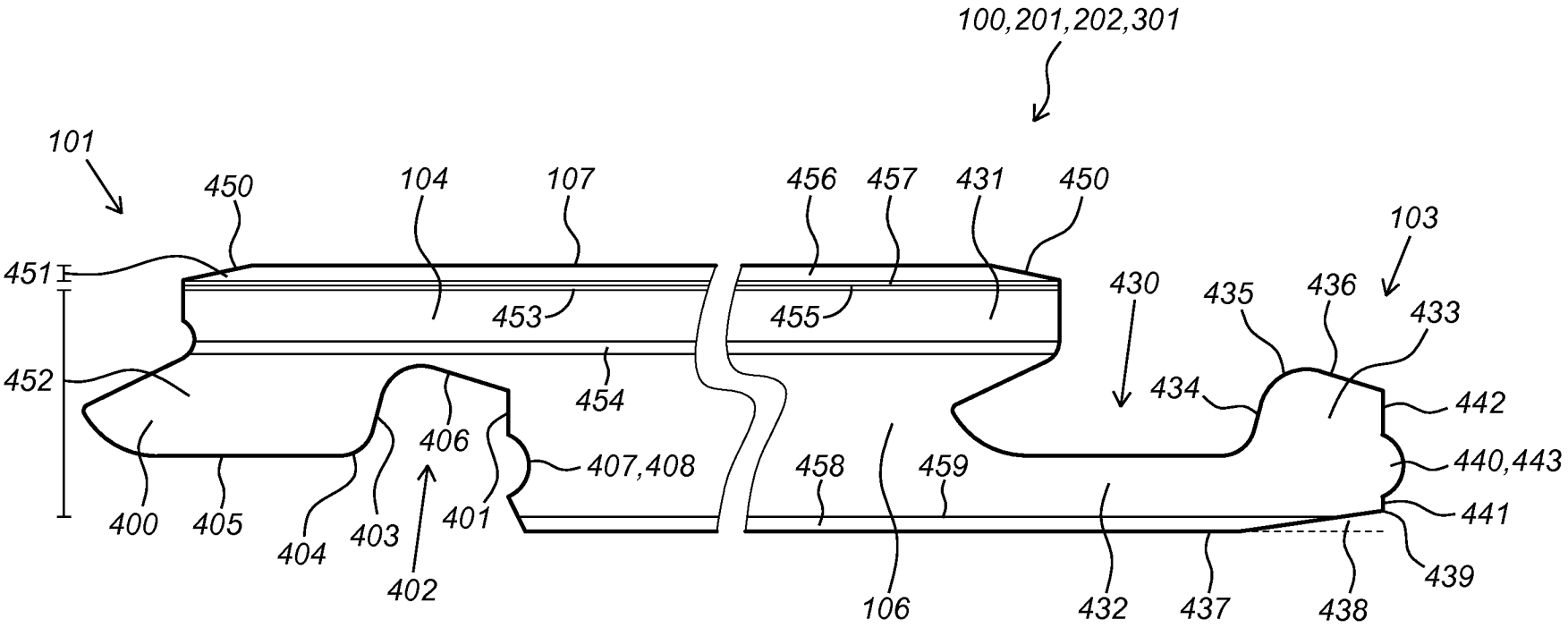
FIG. 4*a* shows a cross-section along line A-A of a multi-purpose tile as shown in FIG. 1*a*, 2*a* or 3*a;*

FIG. 4*a* shows a cross-section along line A-A of a multi-purpose tile (100, 201, 202, 301) as shown in FIG. 1*a*, 2*a* or 3*a*. In the figure, the first edge (101) and an opposing third edge (103) of the tile (100, 201, 202, 301) are visible, having a first coupling profile (104) and a third coupling profile (106) respectively. The first coupling profile (104) comprises a sideward tongue (400) extending in a direction substantially parallel to the upper side (107) of the tile (100, 201, 202, 301), at least one first downward flank (401) lying at a distance from the sideward tongue (400), and a first downward recess (402) formed between the sideward tongue (400) and the first downward flank (401). The proximal side (403) of the sideward tongue (400) of the first coupling profile (104), facing the first downward recess (402), is hereby downwardly inclined in a direction away from the first downward flank (401). It is however likewise possible that the proximal side (403) of the sideward tongue (400) is downwardly inclined in a direction towards the first downward flank (401). A first transition zone (404) can be defined between the proximal side (403) of the sideward tongue (400) of the first coupling profile (104) and a lower side (405) of the sideward tongue (400) of the first coupling profile (104), which first transition zone (404) is in this instance curved. The upper side (406) of the first downward recess (402) is in the depicted tile (100, 201, 202, 301) inclined downwardly towards the first downward flank (401). The first coupling profile (104) may furthermore comprise a first locking element (407) which may, in a coupled position, co-act with a third locking element (440) of a third coupling profile (106) of an adjacent tile (100, 201, 202, 301). This first locking element (407) may be provided at the first downward flank (401) of the first coupling profile (104). In the presently depicted tile (100, 201, 202, 301), the first locking element (407) comprises at least one first locking groove (408).

The third coupling profile (106) comprises a third recess (430) configured for accommodating at least a part of the sideward tongue (400) of the first coupling profile (104) of a further tile (100, 201, 202, 301), said third recess (430) being defined by an upper lip (431) and a lower lip (432), wherein said lower lip (432) is provided with an upward locking element (433). The proximal side (434) of the upward locking element (433) of the third coupling profile (106), facing the third recess (430), is upwardly inclined in a direction away from the upper lip (431). It may however be possible as an alternative that the proximal side (434) of the upward locking element (433) is upwardly inclined in a direction towards the upper lip (431). A third transition zone (435) can be defined between the proximal side (434) of the upward locking element (433) and an upper side (436) of the upward locking element (433), which third transition zone (435) is in this instance also curved to follow the curved first transition zone (404). The upper side (436) of the upward locking element (433) is in the depicted tile (100, 201, 202, 301) inclined downwardly in a direction facing way from the upper lip (431) of the third coupling profile (106). At the lower side (437) of the lower lip (432) of the third coupling profile (106), a recess (438) is present, which extends up to the distal end (439) of the lower lip (432). This recess (438) allows bending of the lower lip (432) in a downward direction. As already mentioned, the third coupling profile (106) may further comprise a third locking element (440) that may co-act with the first locking element (407) of the first coupling profile (104) of an adjacent tile (100, 201, 202, 301) to establish a vertical lock between the coupled tiles (100, 201, 202, 301). The third locking element (440) may hereto provided at a distal side (441) of the lower lip (432) facing away from the third recess (430) and/or at a distal side (442) of the upward locking element (433) facing away from the third recess (430). The third locking element (440) may, as depicted here, specifically be positioned at a distance both from a lower side (437) of the lower lip (432) and an upper side (436) of the upward locking element (433). In the presently depicted tile, the third locking element (440) comprises at least one outward bulge (443) which outward bulge (443) is adapted to be at least partially received in the first locking groove (408) or a second locking groove (423) of an adjacent coupled tile (100, 201, 202, 301) for the purpose of realizing a (vertically) locked coupling.

Figure 4B:
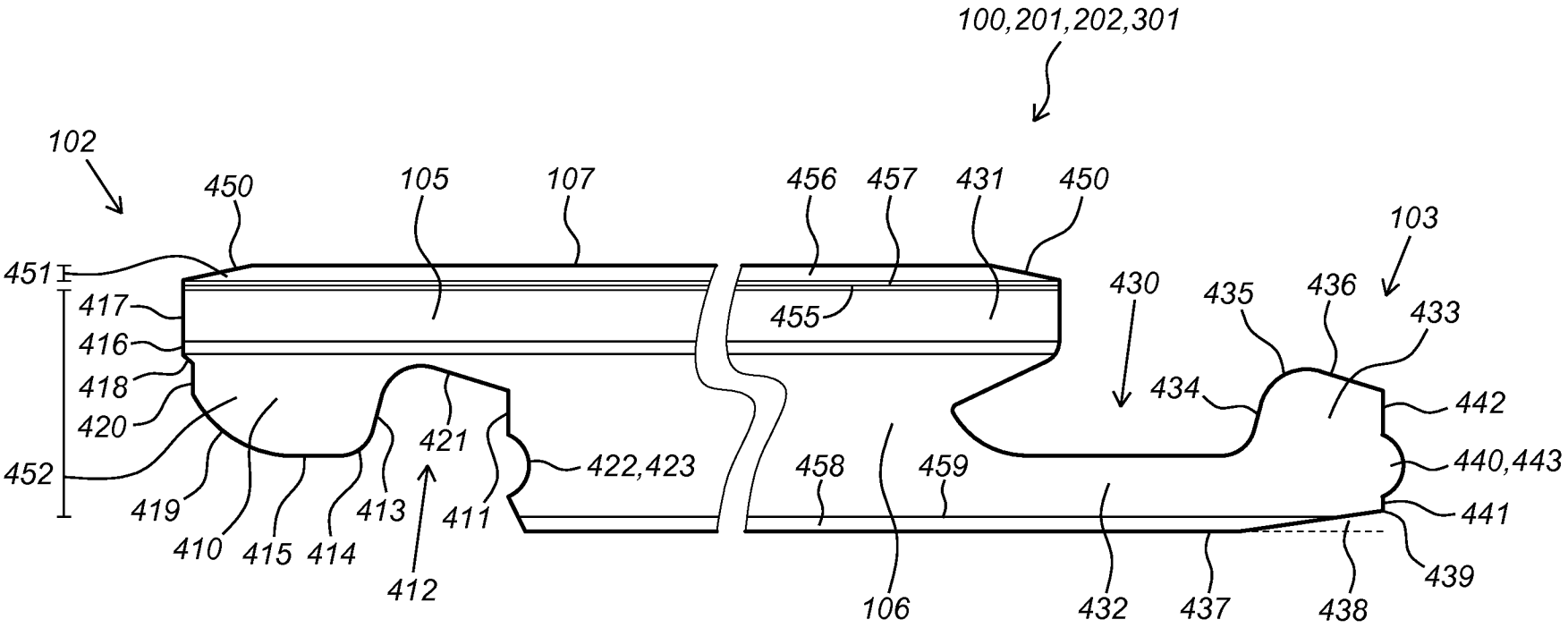
FIG. 4*b* shows a cross-section along line B-B of a multi-purpose tile as shown in FIG. 1*a*, 2*a* or 3*a;*

FIG. 4*b* shows a cross-section along line B-B of a multi-purpose tile (100, 201, 202, 301) as shown in FIG. 1*a*, 2*a* or 3*a*. In the figure, the second edge (102) and another opposing third edge (103) of the tile (100, 201, 202, 301) are visible, having a second coupling profile (105) and a third coupling profile (106) respectively. Where the third coupling profile (106) matches the third coupling (106) profile provided on the adjacent third edge (103) of the tile (100, 201, 202, 301), which characteristics are given above in the description of the cross-section along line A-A of the multi-purpose tile (100, 201, 202, 301), the second coupling profile (105) comprises a downward tongue (410) extending in a direction substantially perpendicular to the upper side (107) of the tile (100, 201, 202, 301), at least one second downward flank (411) lying at a distance from the downward tongue (410), and a second downward recess (412) formed between the downward tongue (410) and the second downward flank (411). The proximal side (413) of the downward tongue (410) of the second coupling profile (105), facing the second downward recess (412), is hereby downwardly inclined in a direction away from the second downward flank (411). It is however also possible that the proximal side (413) of the downward tongue (410) is downwardly inclined in a direction towards the second downward flank (411). A second transition zone (414) can be defined between the proximal side (413) of the downward tongue (410) of the second coupling profile (105) and a lower side (415) of the downward tongue (410) of the second coupling profile (105), which second transition zone (414) is in this instance curved. A distal side (416) of the downward tongue (410), facing away from the second downward recess (412), comprises at least a vertical upper wall part (417) adjacent to the upper side (107) of the tile (100, 201, 202, 301), and, adjacent to and located below said vertical upper wall part (417), an angled wall part (418) that angles inward toward a chamfered and/or curved lower wall part (419) of said distal side (416) of the downward tongue (410). An intermediate vertical wall part (420) may hereby be present between the angled wall part (418) and the chamfered and/or curved lower wall part (419). The lower wall part (419) of distal side (416) of the downward tongue (410) may moreover be connected to the lower side (415) of the downward tongue (410). The upper side (421) of the second downward recess (412) is in the depicted tile (100, 201, 202, 301) inclined downwardly towards the second downward flank (411). The second coupling profile (105) may furthermore comprise at least one second locking element (422) which may, in a coupled position, co-act with a third locking element (440) of a third coupling profile (106) of an adjacent tile (100, 201, 202, 301) to establish a vertical lock between the tiles (100, 201, 202, 301). The second locking element (422) may hereto be provided at the second downward flank (411) of the second coupling profile (105). In the presently depicted tile (100, 201, 202, 301), the second locking element (422) comprises at least one second locking groove (423) adapted to at least partially receive the outward bulge (443) of the third locking element (440) of an adjacent coupled tile (100, 201, 202, 301) for the purpose of realizing a (vertically) locked coupling.

The coupling profiles (104, 105, 106) of each of the multi-purpose tiles (100, 201, 202, 301) shown in FIGS. 4*a* and 4*b* are provided with chamfers (bevels) (450) at or near the upper side (107) of the tiles (100, 201, 202, 301). The tiles (100, 201, 202, 301) comprise an upper substrate (451) affixed to an upper side (453) of a base layer (452) to which the first, second and third coupling profiles (104, 105, 106) are integrally connected. The base layer (452) is provided with at least one reinforcing layer (454) incorporated in the base layer (452). The upper substrate (451) comprises a decorative layer (455), an abrasion resistant wear layer (456) covering said decorative layer (455) and a transparent finishing layer (457) situated in between the decorative layer (455) and the wear layer (456). The tiles (100, 201, 202, 301) moreover comprise a backing layer (458) affixed to a bottom side (459) of the base layer (452).

Figure 5A:
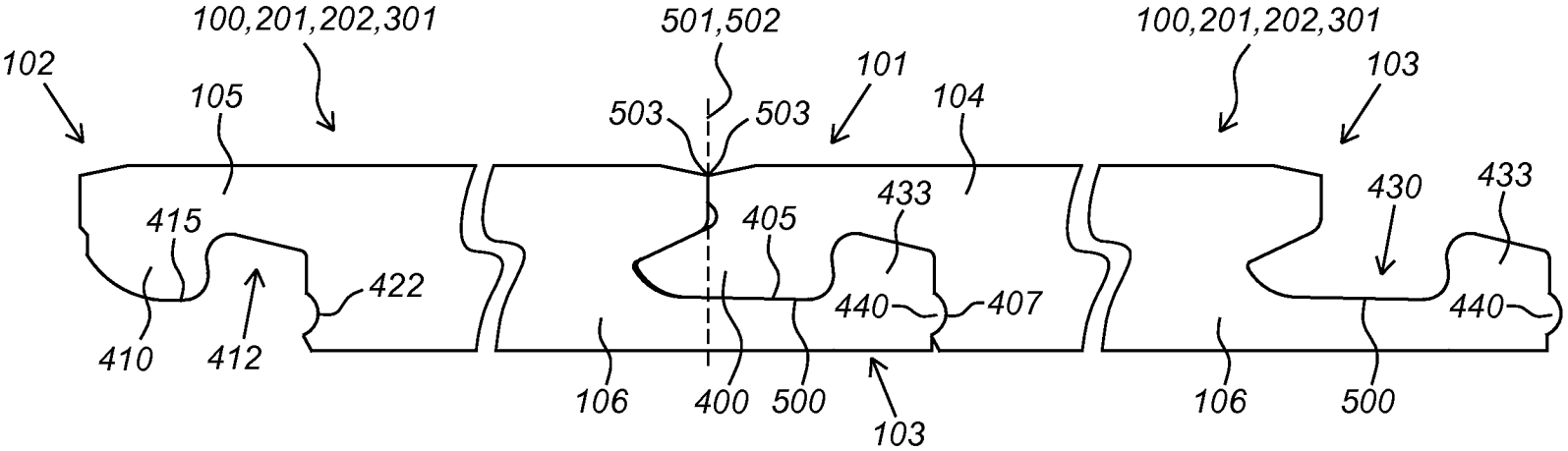
FIGS. 5*a*-5*c* show a cross-section of two multi-purpose tiles as shown in FIG. 1*a*, 2*a* or 3*a* in a first, second and third coupled condition respectively.
Figure 5B:
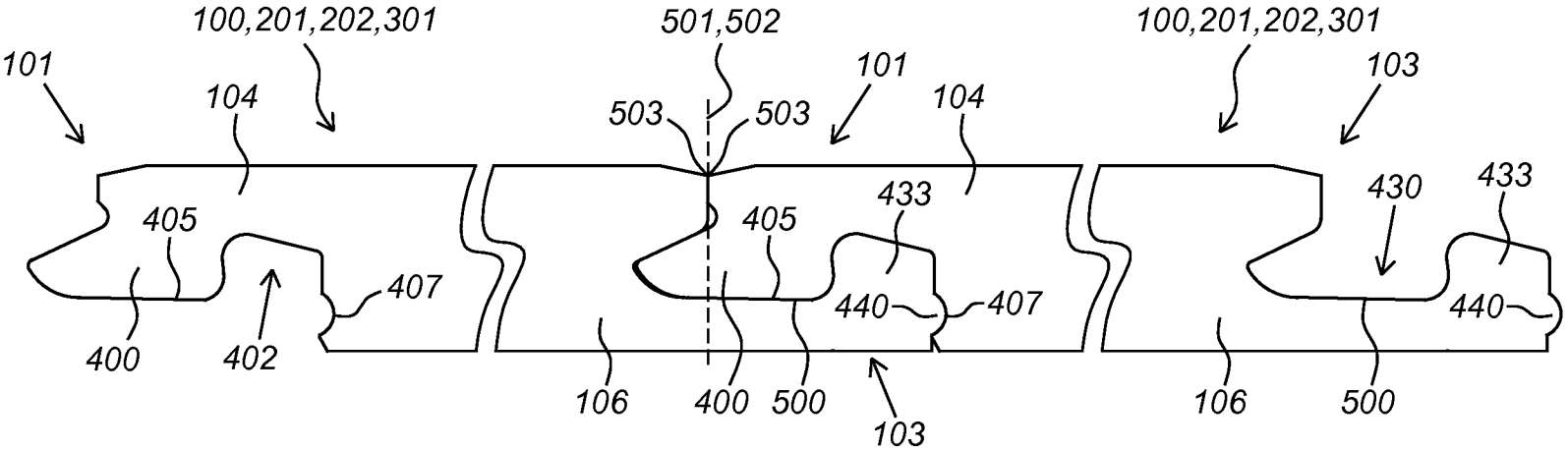
Figure 5C:
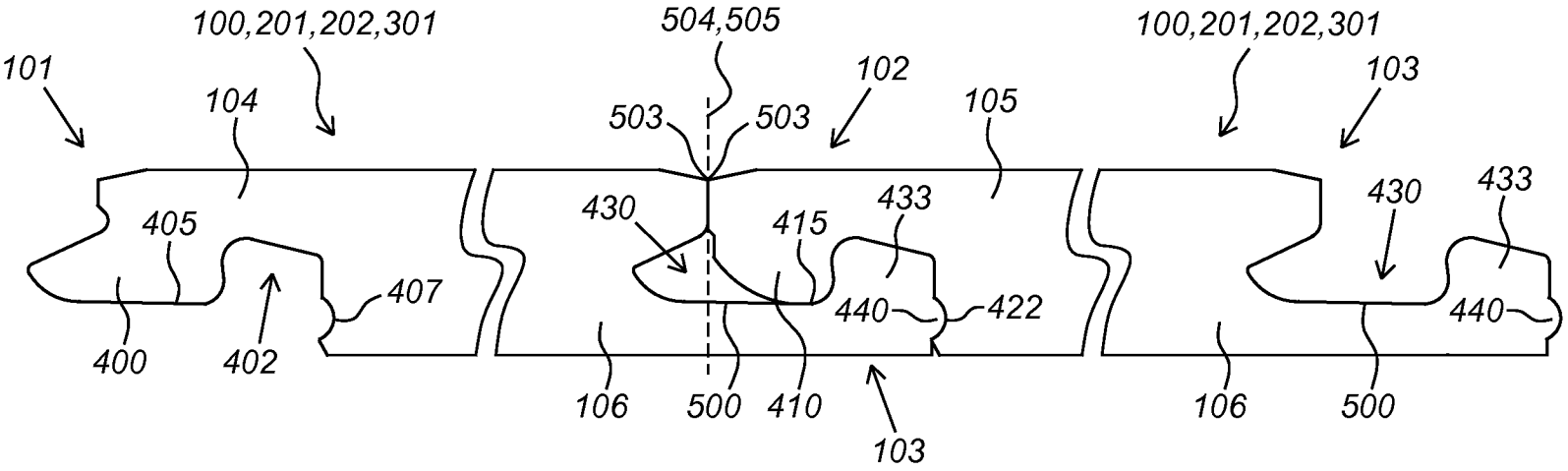

FIGS. 5*a*-5*c* show a cross-section of two multi-purpose tiles (100, 201, 202, 301) as shown in FIG. 1*a*, 2*a* or 3*a* in a first, second and third coupled condition respectively. In these figures it can be seen that in coupled condition, at least a part of the sideward tongue (400) of the first coupling profile (104) of a tile (100, 201, 202, 301) is inserted into the third recess (430) of the third coupling profile (106) of an adjacent tile (100, 201, 202, 301), and at least a part of the upward locking element (433) of the third coupling profile (106) is inserted into the first downward recess (402) of the first coupling profile (104). To establish a fixation in the mutual position of the first coupling profile (104) and the third coupling profile (106), a lower side (405) of the sideward tongue (400) of the first coupling profile (104) may hereby be supported by a lower surface (500) of the third recess (430) of the third coupling profile (106). The first edge (101) and the third edge (103), in coupled condition, define a first closing surface (501) defined as a first vertical plane (502) through the upper edges (503) of the coupled tiles (100, 201, 202, 301). Each of the sideward tongue (400) and the third recess (430) hereby extends through said first vertical plane (502). In the shown embodiments, the first and third coupling profiles (104, 106) respectively comprise a first and third locking element (407, 440). The, optional, first and third locking element (407, 440) are hereby positioned such that the first locking element (407) is facing and co-acting with the third locking element (440) of the third coupling profile (106) to realise a vertical locking effect.

FIGS. 5*a*-5*c* moreover show that in coupled condition, at least a part of the downward tongue (410) of the second coupling profile (105) is inserted in the third recess (430) of the third coupling profile (106), and at least a part of the upward locking element (433) of the third coupling profile (106) is inserted in the second downward recess (412) of the second coupling profile (105). To establish a fixation in the mutual position of the second coupling profile (105) and the third coupling profile (106), a lower side (415) of the downward tongue (410) of the second coupling profile (105) may hereby be supported by a lower surface (500) of the third recess (430) of the third coupling profile (106). The second edge (102) and the third edge (103), in coupled condition, define a second closing surface (504) defining a second vertical plane (505) through the upper edges (503) of the coupled tiles (100, 201, 202, 301). The downward tongue (410) is hereby positioned at one side of said second vertical plane (505), while the third recess (430) extends through said second vertical plane (505). In the shown embodiments, the second coupling profile (105) moreover comprises a second locking element (422). Said second locking element (422) is facing and co-acting with the third locking element (440) of the third coupling profile (106) to realise a vertical locking effect.

Figure 6A:
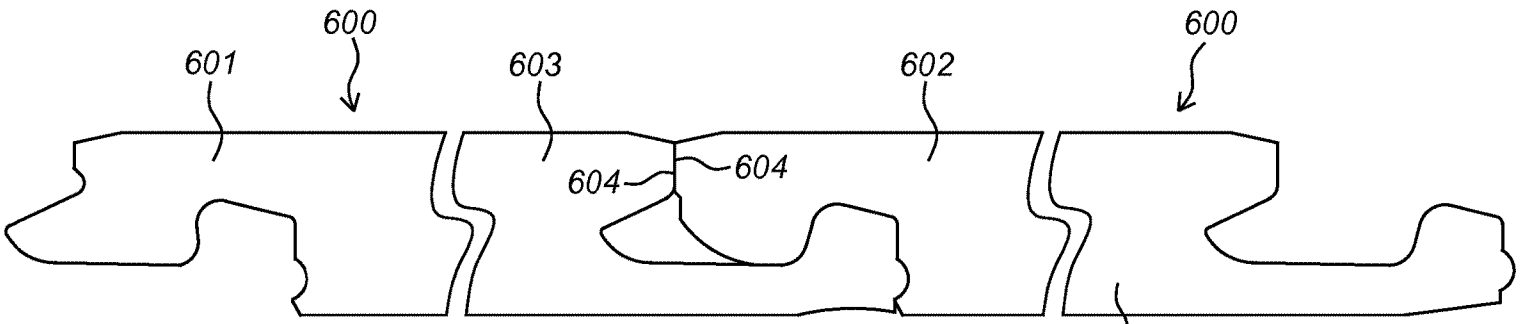
FIGS. 6*a*-6*c* show a cross-section of two multi-purpose tiles with alternative coupling profiles in a first, second and third coupled condition respectively.
Figure 6B:
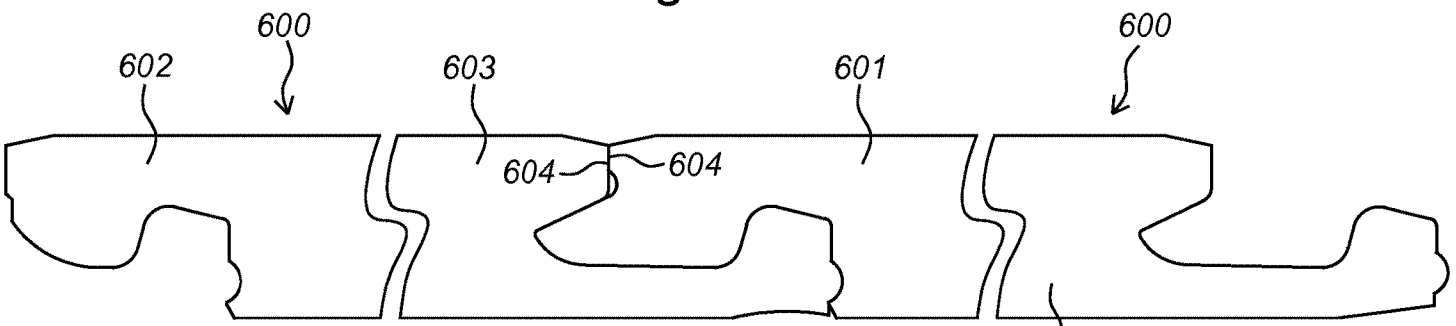
Figure 6C:
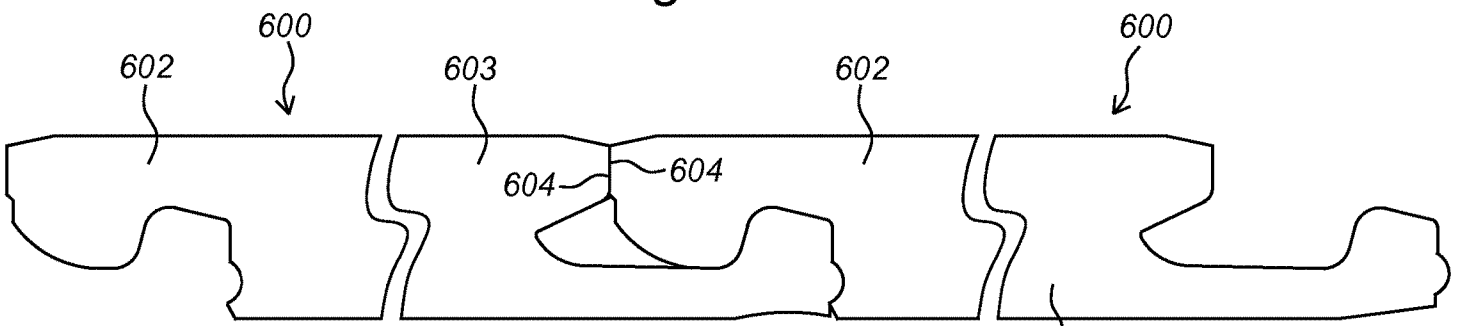

FIGS. 6*a*-6*c* show a cross-section of two multi-purpose tiles (600) with alternative coupling profiles (601, 602, 603) in a first, second and third coupled condition respectively. Wherein the coupling profiles (104, 105, 106) of the tiles (100, 201, 202, 301) shown in FIGS. 5*a*-5*c* are configured such that in a coupled condition, (substantially) no pretension exists between the coupling profiles (104, 105, 106), the coupling profiles (601, 602, 603) of the tiles (600) shown in FIGS. 6*a*-6*c* are configured such that in coupled condition a pretension is existing, which forces the respective tiles (600) at their respective edges (604) towards each other. In the shown embodiments of the coupling profiles (601, 602, 603), the pretension is the result of a (local) deformation of the coupling profiles (601, 602, 603).

Figure 7A:
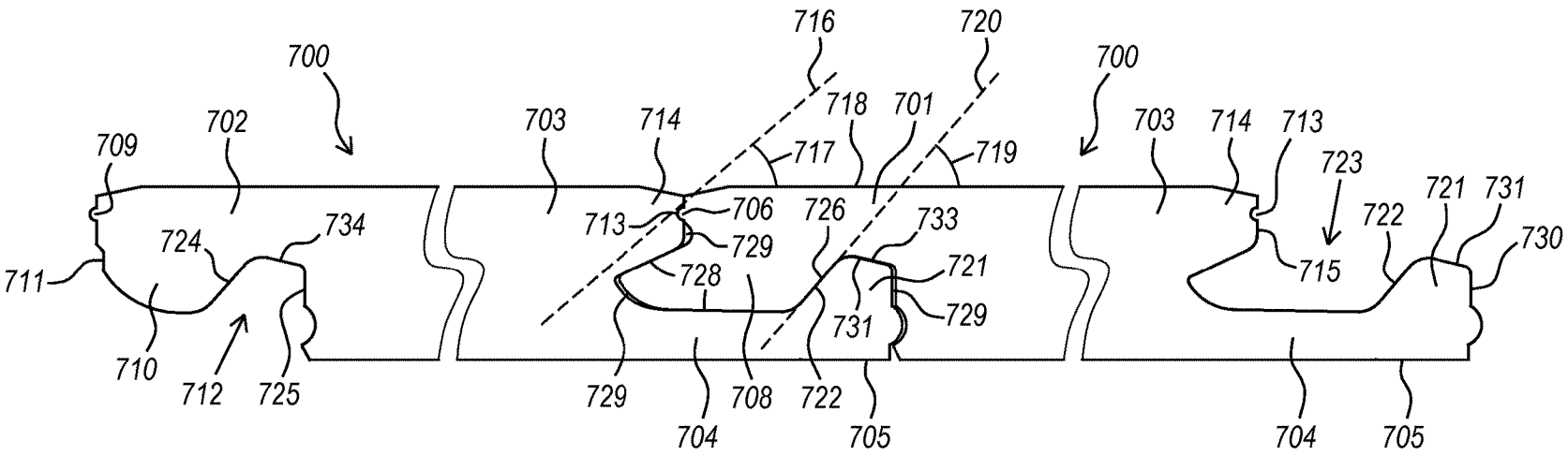
FIGS. 7*a*-7*c* show a cross-section of two multi-purpose tiles with further alternative coupling profiles in a first, second and third coupled condition respectively.
Figure 7B:
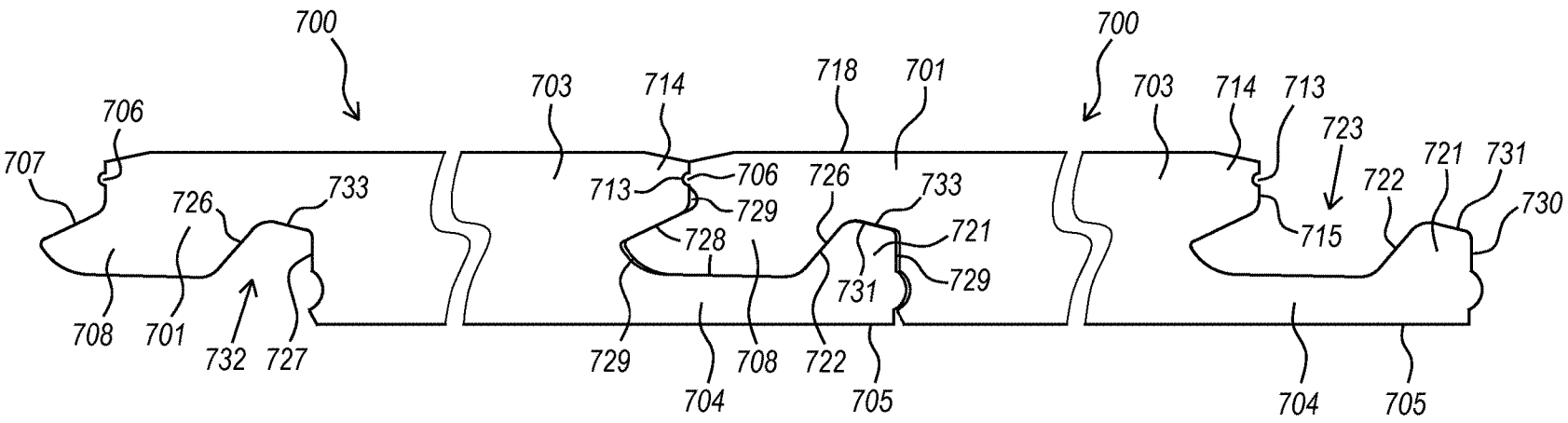
Figure 7C:
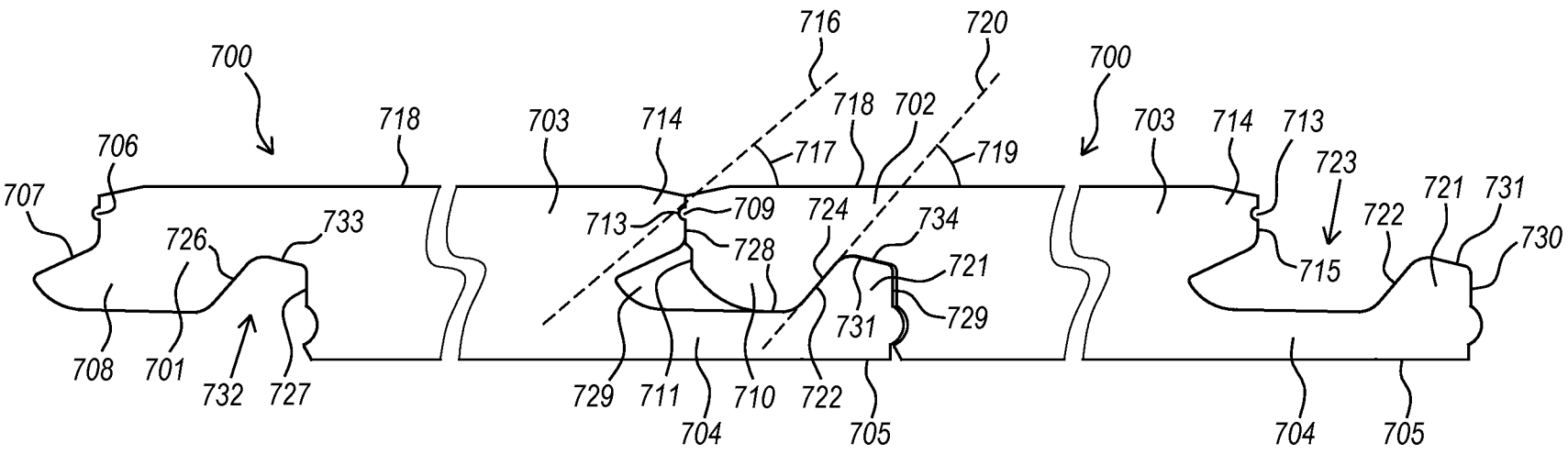

FIGS. 7*a*-7*c* show a cross-section of two multi-purpose tiles (700) with further alternative coupling profiles (701, 702, 703) in a first, second and third coupled condition respectively. In this embodiment of the third coupling profile (703), no recess is present at the lower side (705) of the lower lip (704) thereof. In the depicted multi-purpose tiles (700), the first coupling profile (701) moreover comprises another first locking element (706), provided at a distal side (707) of the first coupling profile (701), being located above at least a part of the sideward tongue (708). In addition, the second coupling profile (702) comprises another second locking element (709), provided at a distal side (711) of the downward tongue (710) facing away from the second downward recess (712). The third coupling profile (703) also comprises another, third, locking element (713), provided at a side (715) of the upper lip (714). In the coupled conditions shown in FIGS. 7*a* and 7*b*, the additional third locking element (713) faces the distal side (707) of the first coupling profile (701) of the adjacent tile (700), while in the coupled condition shown in FIG. 7*c*, the additional third locking element (713) faces the distal side (711) of the downward tongue (710) of the second coupling profile (702) of an adjacent tile (700). Further depicted in FIGS. 7*a*-7*c* is the co-action between the additional first or second locking element (706, 709) and the additional third locking element (713) for creating a vertical locking effect in coupled condition of two tiles (700), defines a tangent T1 (716) which encloses an angle A1 (717) with a plane (718) defined by the tile (700), which angle A1 (717) is smaller than an angle A2 (719) enclosed by said plane (718) defined by the tile (700) and a tangent T2 (720) defined by a co-action between an inclined part of a proximal side (722) of the upward locking element (721) facing toward the third recess (723) and an inclined part of a proximal side (724) of the downward tongue (710) facing toward the second downward flank (725) respectively an inclined part of a proximal side (726) of the sideward tongue (708) facing toward the first downward flank (727).

In the embodiments of the coupling profiles (701, 702, 703) shown in FIGS. 7*a*-7*c*, the first coupling profile (701) and the third coupling profile (703) respectively the second coupling (702) and the third coupling profile (703) are configured such that in coupled condition a plurality of distant contact zones (728) are present, wherein in between each pair of adjacent contact zones (728) a space (729) remains. Specifically, FIGS. 7*a* and 7*b* show that the first downward flank (727) of the first coupling profile (701) and a distal side (730) of the upward locking element (721) and the lower lip (704) of the third coupling profile (703), facing the first downward flank (727), are positioned at a distance from each other. Additionally, the upper side (731) of the upward locking element (721) of the third coupling profile (703) is positioned at a distance from the upper side (733) of the first downward recess (732) of the first coupling profile (701). In FIG. 7*c* one can see that the second downward flank (725) of the second coupling profile (702) and a distal side (730) of the upward locking element (721) and the lower lip (704) of the third coupling profile (703), facing the second downward flank (725), are positioned at a distance from each other. In addition, the upper side (731) of the upward locking element (721) of the third coupling profile (703) is positioned at a distance from the upper side (734) of the second downward recess (712) of the second coupling profile (702).

Hence, the above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application. It is explicitly emphasized here that all mathematical combinations are possible among the features mentioned above and referred to in the claims as filed, as far as the respectively obtained combination does not include any contradictory characteristics. In this manner, this application thus also forms a reservoir of possibilities of claimed subject-matter.

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

The invention claimed is:

1. A multi-purpose tile system, comprising a plurality of tiles, wherein a first tile of the plurality of tiles comprises:

at least one first edge having a first coupling profile comprising:

a sideward tongue extending in a direction substantially parallel to an upper side of the first tile, at least one first downward flank lying at a distance from the sideward tongue, and a first downward recess formed between the sideward tongue and the at least one first downward flank, wherein at least a part of a proximal side of the sideward tongue of the first coupling profile, facing the first downward recess, is downwardly inclined in a direction away from the at least one first downward flank, in such a way that an angle is enclosed perpendicular to a plane defined by the first tile wherein said angle is situated between 0 and 60 degrees;

at least one second edge having a second coupling profile comprising:

a downward tongue extending in a direction substantially perpendicular to the upper side of the first tile, at least one second downward flank lying at a distance from the downward tongue, a second downward recess formed between the downward tongue and the at least one downward flank, and at least one first locking element defined in the at least one second downward flank, wherein at least a part of a proximal side of the downward tongue, facing the second downward recess, is downwardly inclined in a direction away from the at least one second downward flank, in such a way that an angle is enclosed perpendicular to the plane defined by the first tile wherein said angle is situated between 0 and 60 degrees;

at least two other edges, each of the at least two other edges having a third coupling profile comprising:

a third recess configured for accommodating at least a part of the sideward tongue of the first coupling profile of a second tile of the plurality of tiles and at least a part of a downward tongue of the second tile, wherein said second tile comprises identical coupling profiles as the first tile, said third recess being defined by an upper lip and a lower lip, wherein said lower lip is provided with an upward locking element, and at least one second locking element, wherein at least a part of a proximal side of the upward locking element, facing the third recess, is upwardly inclined in a direction away from the upper lip, in such a way that an angle is enclosed perpendicular to the plane defined by the first tile and the second tile wherein said angle is situated between 0 and 60 degrees;

wherein the first coupling profile and the third coupling profile are configured such that the first tile and the second tile can be coupled to each other at the at least one first edge and the at least two other edges through a turning movement, wherein, in coupled condition:

at least a part of the sideward tongue of the first coupling profile of the first tile is inserted into the third recess of the third coupling profile of the second tile to realise a vertical locking effect, and at least a part of the upward locking element of the third coupling profile, and at least one outward bulge, are inserted into the first downward recess of the first coupling profile, wherein the second coupling profile and the third coupling profile are configured such that the first tile and the second tile can be coupled to each other at the at least one second edge and the at least two other edges by means of a fold-down movement or a vertical movement, wherein, in coupled condition:

at least a part of the downward tongue of the second coupling profile is inserted in the third recess of the third coupling profile, at least a part of the upward locking element of the third coupling profile is inserted in the second downward recess of the second coupling profile, and the at least one first locking element is facing, and configured to co-act with, the at least one second locking element to realise the vertical locking effect, wherein, responsive to the turning movement of the first tile, the at least one first downward flank is configured to face the at least one second locking element of the third coupling profile of the second tile, wherein at least one tile comprises a base layer and at least one upper substrate affixed, directly or indirectly, to an upper side of said base layer, wherein said at least one upper substrate comprises a veneer layer, and wherein at least one third locking element is provided entirely on a vertical upper wall part of the sideward tongue and/or of the downward tongue, said vertical upper wall being positioned adjacent to the upper side of the first tile, said vertical upper wall part of the sideward tongue and/or of the downward tongue includes a lower portion and an upper portion, in which the at least one third locking element is positioned above the lower portion of the vertical upper wall part of the sideward tongue and/or of the downward tongue and;

wherein the upper lip of the third recess comprises a corresponding at least one fourth locking element provided entirely on a vertical upper wall part of the upper lip positioned adjacent to the upper side of the second tile, wherein the vertical upper wall part of the upper lip includes a lower portion and an upper portion, in which the at least one fourth locking element is provided above the lower portion of the vertical upper wall part of the upper lip, and wherein the at least one third locking element and the at least one fourth locking element are configured to, in a coupled condition, contact one another and thereby create a vertical locking effect when in the coupled condition of the two tiles.

2. The tile system according to claim 1, wherein said veneer layer has a Mohs hardness of greater than 3.

3. The tile system according to claim 1, wherein said veneer layer is composed of a material selected from a group consisting of natural stone, marble, granite, slate, glass, and ceramics.

4. The tile system according to claim 1, wherein said veneer layer is a ceramic of a type selected from a group consisting of Monocuttura ceramic, Monoporosa ceramic, porcelain ceramic, or multi-casted ceramic.

5. The tile system according to claim 1, wherein said veneer layer has a thickness of between 2 and 8 mm.

6. The tile system according to claim 1, wherein said veneer layer being dimensioned so as not to overlie the supporting base layer and/or the at least one or more coupling profiles applied.

7. The tile system according to claim 1, wherein each tile of the plurality of tiles comprises a hot-melt adhesive layer to affix the at least one upper substrate, directly or indirectly, onto the base layer.

8. The tile system according to claim 1, wherein said base layer and/or another layer of the tile comprises wood-based material.

9. The tile system according to claim 1, wherein said at least one first locking element comprises a recess defined in the at least one second downward flank, and wherein said at least one second locking element comprises the at least one outward bulge extending from an upward tongue.

10. The tile system, according to claim 1, wherein the second tile is structured the same as the first tile, wherein a third tile of the plurality of tiles is structured the same as the first tile, and wherein the first coupling profile of the first tile and a third coupling profile of the third tile are configured such that the first tile and the third tile can be coupled to each other at the at least one first edge and the at least two other edges by means of the turning movement, wherein, in coupled condition:

at least a part of the sideward tongue of the first coupling profile of the first tile is inserted into the third recess of the third coupling profile of the third tile, and at least a part of the upward locking element of the third coupling profile of the third tile is inserted into a first downward recess of the first coupling profile of the first tile.

11. The tile system according to claim 1, wherein the first coupling profile and the third coupling profile are configured for locking together the first tile and the second tile both vertically and horizontally, and wherein the second coupling profile and the third coupling profile are configured for locking together the first tile and the second tile both vertically and horizontally.

12. The tile system according to claim 1, wherein the at least one first locking element of the second coupling profile is provided at the at least one second downward flank of the second coupling profile, and wherein the at least one second locking element of the third coupling profile is provided at a distal side of the lower lip facing away from the third recess and a distal side of the upward locking element facing away from the third recess.

13. The tile system according to claim 1, wherein the at least one first locking element of the second coupling profile is provided at a distal side of the downward tongue facing away from the second downward recess, and wherein the at least one second locking element of the third coupling profile is provided at a side of the upper lip, in coupled condition facing said distal side of the downward tongue of the second coupling profile of the first tile.

14. The tile system according to claim 1, wherein said at least one third locking element and said at least one fourth locking element are positioned closer to the upper side of the first tile compared to an upper side of the upward locking element.

15. The tile system according to claim 1, wherein the at least one second locking element of the third coupling profile is provided at a distal side of the lower lip facing away from the third recess and a distal side of the upward locking element facing away from the third recess.

16. The tile system according to claim 1, wherein at a lower side of the lower lip of the third coupling profile, a recess is present, which extends up to a distal end of the lower lip and which allows a bending of the lower lip in a downward direction.

17. The tile system according to claim 1, wherein the difference between the upper lip and the lower lip, measured in a plane of the tile is larger than 1.0 times a thickness of each of the plurality of tiles.

18. The tile system according to claim 1, wherein said base layer comprises at least one composite material of at least one polymeric material and at least one non-polymeric material.

19. The tile system according to claim 18, wherein the at least one non-polymeric material is selected from a group consisting of: talc, chalk, wood, calcium carbonate, and a mineral filler.

20. The tile system according to claim 1, wherein in coupled condition of the second coupling profile of the first tile and the third coupling profile of the second tile, a distal side of the upward locking element of said first tile is at least partially situated at a distance from a facing second downward flank of said second tile.

* * * * *